US007145070B2

(12) United States Patent
Barry

(10) Patent No.: US 7,145,070 B2
(45) Date of Patent: Dec. 5, 2006

(54) DIGITAL MUSICAL INSTRUMENT SYSTEM

(75) Inventor: James Anthony Barry, Dublin (IE)

(73) Assignee: Thurdis Developments Limited, Dublin (IE)

( * ) Notice: Subject to any disclaimer, the term of this patent is extended or adjusted under 35 U.S.C. 154(b) by 0 days.

(21) Appl. No.: 10/520,223

(22) PCT Filed: Jul. 14, 2003

(86) PCT No.: PCT/IE03/00102

§ 371 (c)(1),
(2), (4) Date: Jan. 4, 2005

(87) PCT Pub. No.: WO2004/008430

PCT Pub. Date: Jan. 22, 2004

(65) Prior Publication Data

US 2005/0235813 A1 Oct. 27, 2005

(30) Foreign Application Priority Data

Jul. 12, 2002 (IE) ..... S2002/0580

(51) Int. Cl.
*G10H 3/00* (2006.01)

(52) U.S. Cl. ..... 84/723; 84/731

(58) Field of Classification Search ..... 84/723, 84/453, 72, 609, 610, 731
See application file for complete search history.

(56) References Cited

U.S. PATENT DOCUMENTS 2,986,953 A * 6/1961 De Armond et al. ..... 74/478
4,468,999 A * 9/1984 Bonanno ..... 84/687
4,630,520 A * 12/1986 Bonanno ..... 84/655
4,791,848 A 12/1988 Blum, Jr.
5,033,353 A 7/1991 Fala et al.
5,455,381 A * 10/1995 Juszkiewicz et al. ..... 84/731
5,723,802 A 3/1998 Johnson et al.

FOREIGN PATENT DOCUMENTS

EP 1081680 3/2001
WO WO 0195052 12/2001

* cited by examiner

*Primary Examiner*—Lincoln Donovan
*Assistant Examiner*—Christina Russell
(74) *Attorney, Agent, or Firm*—Hoffmann & Baron, LLP

(57) ABSTRACT

The present invention provides an interactive multimedia apparatus (1, 11, 21) comprising a digital musical instrument (3, 14, 24, 41) and having a plurality of control members (42, 44, 45, 46) including at least one limited state (on/off) control member (44) and one or more dynamic range state control members (42, 45, 46). A central control unit (2, 12, 22) is also provided having a store of digital media stored thereon and a suite of software for interpreting the state of the control members (42, 44, 45, 46) in order to select, open and render the digital media. A control unit is associated with the digital musical instrument (3, 14, 24, 41) and has a CPU and a sensing means for identifying the state of the control members (42, 44, 45, 46). The control unit has means for communicating the current state of the control members (42, 44, 45, 46) to the central control unit (2, 12, 22) and the apparatus is characterised in that the sensing means comprises a plurality of independent transducers each of which monitors the activation of a separate dynamic range state control member (42, 45, 46).

18 Claims, 18 Drawing Sheets

Note: 1. All resistors 4k7 except where stated

Note: 1. All resistors 4k7 except where stated

FIGURE 10

Label A

| THE DIATONIC C SCALE: | | | | | | | | | | | | |
|---|---|---|---|---|---|---|---|---|---|---|---|---|
| | | | | | | | | | | | | |
| C | $C^{\#}$ | D | $D^{\#}$ | E | F | $F^{\#}$ | G | $G^{\#}$ | A | $A^{\#}$ | B | C |
| | | | $D^{b}$ | | | $E^{b}$ | $B^{b}$ | | $G^{b}$ | | $A^{b}$ | |

| SELECTED INSTRUMENTS (EXAMPLE MENU) |
|---|
| ELECTRIC GUITAR |
| OVERDRIVE GUITAR |
| DISTORTION GUITAR |
| ACOUSTIC BASS |
| ELECTRIC PICK |
| ORGAN |
| PIANO |
| TRUMPET |
| ETC. |

Label B

| EXAMPLE: 'C' CHORD CHOICES | |
|---|---|
| C | C6 |
| Cm | Cm6 |
| Cdim | CM7 |
| Caug | CM9 |
| Csus | C7 |
| C2 | Cm7 |

DIGITAL MUSICAL INSTRUMENT SYSTEM

This application is the U.S. National Phase of International Application No. PCT/IE2003/000102 filed on 14 Jul. 2003, which is incorporated herein by reference.

BACKGROUND OF THE INVENTION

The present invention relates to an interactive multimedia apparatus.

The present invention is an improvement to invention disclosed in International publication No. WO 01/95052 by the same inventor, the contents of which are incorporated herein by reference thereto.

It is an object of the present invention to provide an interactive multimedia apparatus which will provide users with a digital instrument platform allowing a wider range of more challenging experiences. Additionally, it presents users with a sophisticated digital musical instrument which will enable them to create musical and other multimedia content as if they were accomplished musicians/artists. Additionally, it is an object of the invention to allow non-musical trained users to compose, accompany, solo, gig and have fun as if they were an accomplished instrument player. Finally, it is an object of the present invention to assist users in developing knowledge of chord structures, complex chord structures, voicing, scales and the fingering of notes on the fret of stringed instruments.

SUMMARY OF THE INVENTION

Accordingly, the present invention provides an interactive multimedia apparatus comprising:—

- a digital musical instrument having a plurality of control members including at least one limited state (on/off) control member and at least dynamic range state control member;
- a central control unit having a store of digital media stored thereon and a suite of software for interpreting the state of the control members in order to select, open and render the digital media;
- a control unit associated with the digital musical instrument having a CPU and a sensing means for identifying the state of the control members, the control unit having means for communicating the current state of the control members to the central control unit;
- a means for communications between the central control unit and the CPU; and
- the sensing means comprising a plurality of independent transducers each of which monitors the activation of a separate dynamic range state control member.

Advantageously, the provision of an independent transducer to monitor each dynamic range state control member dramatically increases the functionality of the apparatus and further increases the interaction between an operator and the apparatus allowing an operator greater control over the output generated by the apparatus.

Preferably, the independent transducers are selected from a group of electrical, optical, pressure, movement, magnetic and piezo-electric transducers.

All of these types of transducers provide acceptable solutions for the sensing of vibrations, and the amplitude of the vibrations.

Ideally, the piezo-electric transducer is selected from a group consisting of piezo-electric crystal transducers, piezo-electric ceramic transducers and piezo-electric film transducers.

In a particularly preferred embodiment, the piezo-electric transducer is a piezo-electric crystal transducer.

Preferably, the digital musical instrument is a guitar/guitar type device.

Ideally, a number of the dynamic range state control members are strings of a stringed instrument.

Preferably, each independent transducer monitors one individual string and converts movement of the string into electrical signals.

Ideally, at least one dynamic range state control member is a foot pedal.

Preferably, one or each foot pedal is monitored by a potentiometer.

Ideally, activation of the foot pedal dynamically modifies a variable control such as volume, pan or special effect parameter controls.

Preferably, the central control unit has a visual display unit (V.D.U.) and the suite of software has a graphical user interface (G.U.I) displayable on the V.D.U.

Ideally, the control unit of the digital musical instrument has a control panel comprising a plurality of limited state control members, namely switches for navigating through the G.U.I. of the software suite and also modifying the parameters of the software suite.

Preferably, the central control unit has memory for storing user assignments of digital media against specific control members using the control panel, the memory being accessible by a software module of the software suite in response to activation of a control member or by activation of a combination of one or more limited state or dynamic range state control members to open, render, modify, adjust, add effects, change parameters and change controls of the rendered digital media.

Ideally, indicators are provided on the digital musical instrument and are controllable by software on the central control unit in response to an assignment of digital media against specific control members by a user, the indicators being provided to show the user which of the dynamic range state control members have been assigned to produce an audio/visual output if activated.

Preferably, the indicators are a plurality of light emitting diodes disposed on the digital musical instrument below each string, each L.E.D. being associated with one string.

Ideally, at least one limited state (on/off) control member and at least one dynamic range state control member are provided.

Preferably, between one and sixteen limited state (on/off) control members and between one and twelve dynamic range state control members are provided.

Ideally, each control member is associatable with any file stored in the store of the central control unit.

Preferably, at least some of the digital audio files are recorded instrument notes from a plurality of stringed instrument types.

Ideally, the store further comprises a chord and scale store of digital media containing the note associations for a wide range of defined chord and scale sequences, the store also defining the correct note associated with each string position for the selected chord or limited scale sequence so that the notes are played in the correct sequence when the strings are strummed up or down.

Ideally, the central control unit has input/output connections for the Internet.

Preferably, the software in the central control unit detects the length, and amplitude and the frequency of the electrical signals received from the digital musical instrument in response to a control member's excitation and alters its rendering of the digital media mapped to that control member or any other control member in sympathy with that excitation.

The software always generates an output even if the user operates the control members at the wrong time or incorrectly and in which the outputs provided are sympathetic to the main track's structure and melody.

Ideally, the digital media are rendered simultaneously with a CD, DVD or other primary source of music playing on the audio-visual equipment. Sound is generated in direct response to an operator's action, which enhances the overall musical experience for the operator.

Preferably, the apparatus is provided with a series of special effect controls which when operated by a user send signals to the software to produce a variety of special effects on the digital media output. There are a variety of different ways of manipulating sounds using effects. Frequencies of samples can be raised or lowered, resonance can be distorted (overdrive) or echo can be added through delay and feedback.

Conveniently, the apparatus includes means for storing the newly generated output to any desired storage device such as a hard disk, a compact disc, a DVD device or the like.

Preferably, the apparatus includes a series of visual display screens which are operable to enable a user to launch a game experience, select different operating modes, choose a source music device, select a backing track and/or assign digital sound effects files to the special effects controls on the digital musical instrument.

Optionally, the digital media may contain a riff, a sample, a loop or a track. A riff is a series of notes that form a section of a musical track. A song might contain a guitar riff of eight notes followed by a series of guitar riffs to form a lead solo. Some software music studios have riff generators that allow the creation of unique riffs instead of using pre-recorded riffs. There are also different digital storage formats for riffs such as .wav and .mp3. A sample is a pre-recorded piece of music that is usually not very long such as a five-second bass riff, or a two-second drum loop. Many CD's are available that offer thousands of royalty-free sound samples. A loop is a riff that when repeated over and over again forms a seamless track of music. A bass loop may contain a six-note riff that can be repeated a number of times to form some of the bass-line of a song.

Preferably, the apparatus includes an interface for sending the electrical signals generated by the transducers to the central control unit, the interface being provided between the transducers and the input port of the central control unit, the interface unit enabling the user to generate a plurality of different control signals to the central control unit.

Ideally, the interface includes an amplifier and level detectors to detect the force with which the user strums or strikes the strings. The software includes means to decipher the electrical signals from the instrument and alter one or more parameters of the rendered media in sympathy with the force of the string excitation.

Ideally, the interface unit is provided with a potentiometer which varies the duration of the sound of the digital media file.

Ideally, customised driver software is provided with the instrument avoiding the necessity for calibration.

Preferably, the communication means deployed between the digital musical instrument and the central control unit is a Universal Serial Bus (USB).

Preferably, the central control unit comprises a personal computer, a cable or satellite television decoder or a games console and the audio/audio-visual means comprises a mono or stereo high fidelity audio apparatus, a television, a monitor or a like audio/audio-visual output means.

In a still further aspect of the invention, an operator can use the digital musical instrument and the software interface as a sixteen or twenty-four track-recording studio. The studio allows an operator to save their compositions in a format for future rendering and also in a format for writing their own CD's. Other export formats are MP3 and wav.

Ideally, an operator can drop samples of riffs and loops onto individual tracks to compose their own music/songs. Bass loops, drum loops, rhythm guitar and lead guitar riffs and loops in different musical instruments are provided. Samples are available on CDs and can be downloaded from the Internet.

Preferably, the user will be able to set beats per minute BPM, create his own riffs, loops, and effects and change the pitch of selected sections. BPM stands for beats per minute and is also known as the tempo of a song, or in other words the speed at which a song is played. Different songs will have different BPM e.g. a lot of Techno/Dance/Hip-Hop will have 130–180 BPM. It is important when creating a song made up of sample riffs and loops that all the samples have the same BPM. Some software programs allow the transposition of samples from one tempo to another without changing the pitch of the sample.

Ideally, a number of digital musical instruments can be connected to the central control unit at one time allowing multi-user operation of the apparatus. One guitarist could control the lead guitar, another the bass, and another the rhythm guitar and roles could be switched while playing. In Jam mode, players could improvise by playing over specially composed songs or by playing their own tracks/songs or by playing in random selection mode. In this mode a number of operators could have a 'battle of the bands' competition against each other.

In another aspect of the invention, an operator uses the apparatus as a learning aid and has to strum to the correct tempo of the music as well as making different track selections and adding the proper effects at the right time.

In a further aspect of the invention, the apparatus is used as a controller to bring the operator through different levels of a custom designed computer game. The game plot could go through different levels of becoming a rock star such as going to music school, learning to play, forming a band, writing songs, playing gigs, getting a manager, recording in a studio, getting a record deal, releasing an album, designing CD sleeves, making a pop/rock video, animations/clips etc, competing in the charts and all the various stages could be conducted as a competition over the Internet.

Most guitar players write songs initially as a sequence of Chords. There are numerous music books available to give the guitar tablature (Chords) for different music albums/styles. These could also be provided from a website.

The present invention is a combination of digital hardware and computer software program. It operates on mass market computer-based multimedia platforms, i.e. personal computers or games consoles such as Sony Playstation, Microsoft X-Box or Nintendo Dreamcast (APS Registered Trade Marks).

The digital media content for use with the invention can be any third-party generated media that can be rendered on a personal computer or games console.

The content also includes discrete soundbites (effects sounds, i.e. riffs, beats, loops etc. selectable by the switches on the peripheral) that can be triggered during the playback experience.

BRIEF DESCRIPTION OF THE DRAWINGS

The invention will now be described with reference to the accompanying drawings, which show, by way of example only, an interactive multimedia apparatus in accordance with the invention in which:—

FIG. 10 is a menu of all C chord variations held in the store;

DETAILED DESCRIPTION OF THE INVENTION

Figure 1:
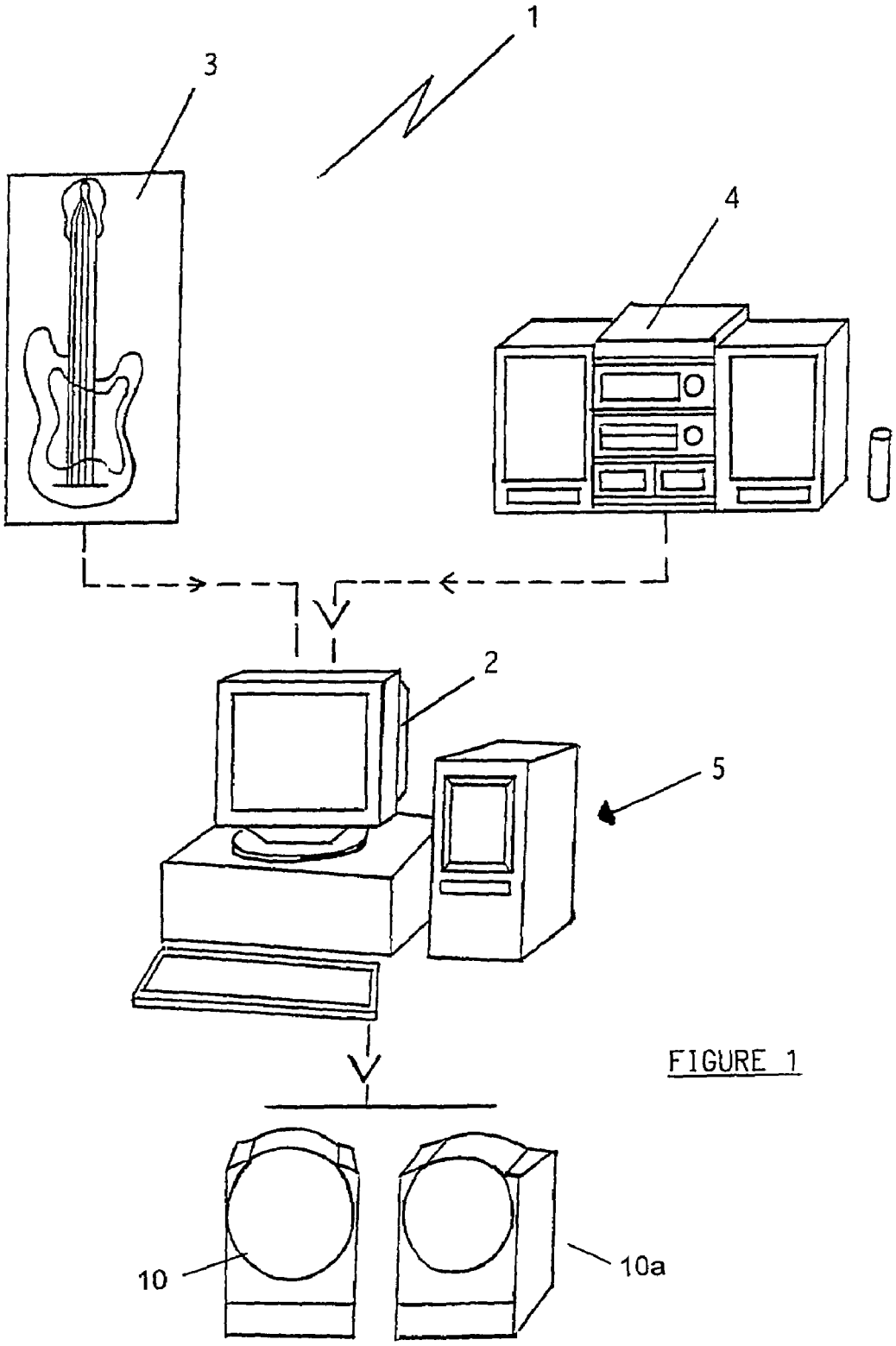
FIG. 1 is a pictorial representation of a first embodiment of interactive multimedia apparatus.

Referring to the drawings and initially to FIG. 1 there is shown an interactive multimedia apparatus indicated generally by the reference numeral 1. The apparatus 1 comprises a central control unit provided by a PC 2 in this embodiment. The PC 2 can store any number of digital media in any desired file format on a hard drive and has I/O connections for a digital musical instrument provided by a guitar 3 in this embodiment. The PC 2 also has an I/O connection for audio-visual equipment provided by an audio unit 4 and Internet access via a modem 5. Alternatively, the speakers 10, 10A and drive means (sound card) can form part of the PC 2.

Figure 2:
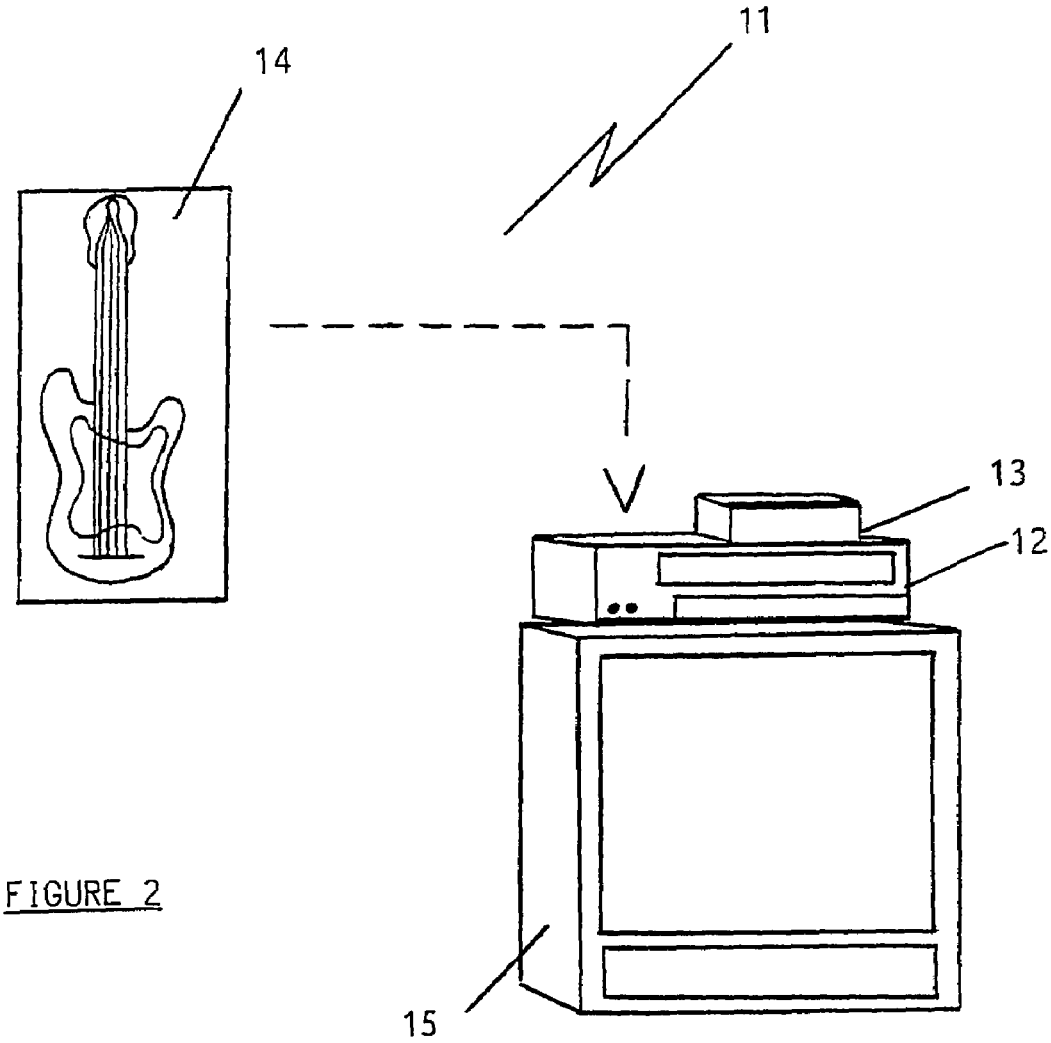
FIG. 2 is a pictorial representation of a second embodiment of the interactive multimedia apparatus.

Referring to the drawings and now to FIG. 2 there is shown a second embodiment of an interactive multimedia apparatus indicated generally by the reference numeral 11. The apparatus 11 comprises a central control unit provided by a set top box 12 having a facility to store any number of digital media in any desired file format downloaded over a cable TV modem 13. The central control unit 12 receives electrical signals from the guitar 14. In response to electrical signals from the guitar 14, the software of the central control unit 12 generates an audible output signal from the digital media to the audio-visual equipment 15 in direct response to an input from the user of the guitar 14.

Figure 3:
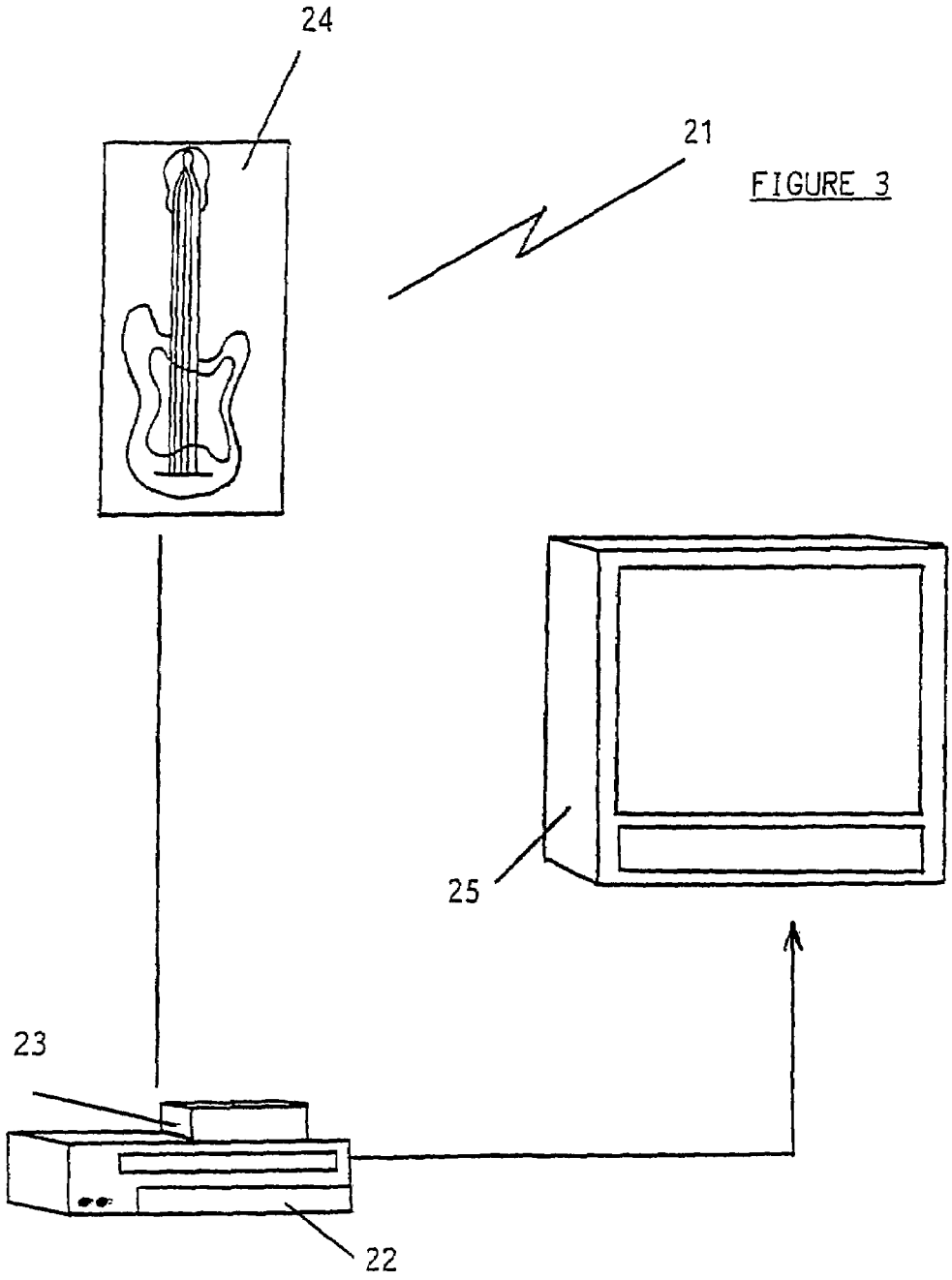
FIG. 3 is a pictorial representation of a third embodiment of the interactive multimedia apparatus.
Figure 4:
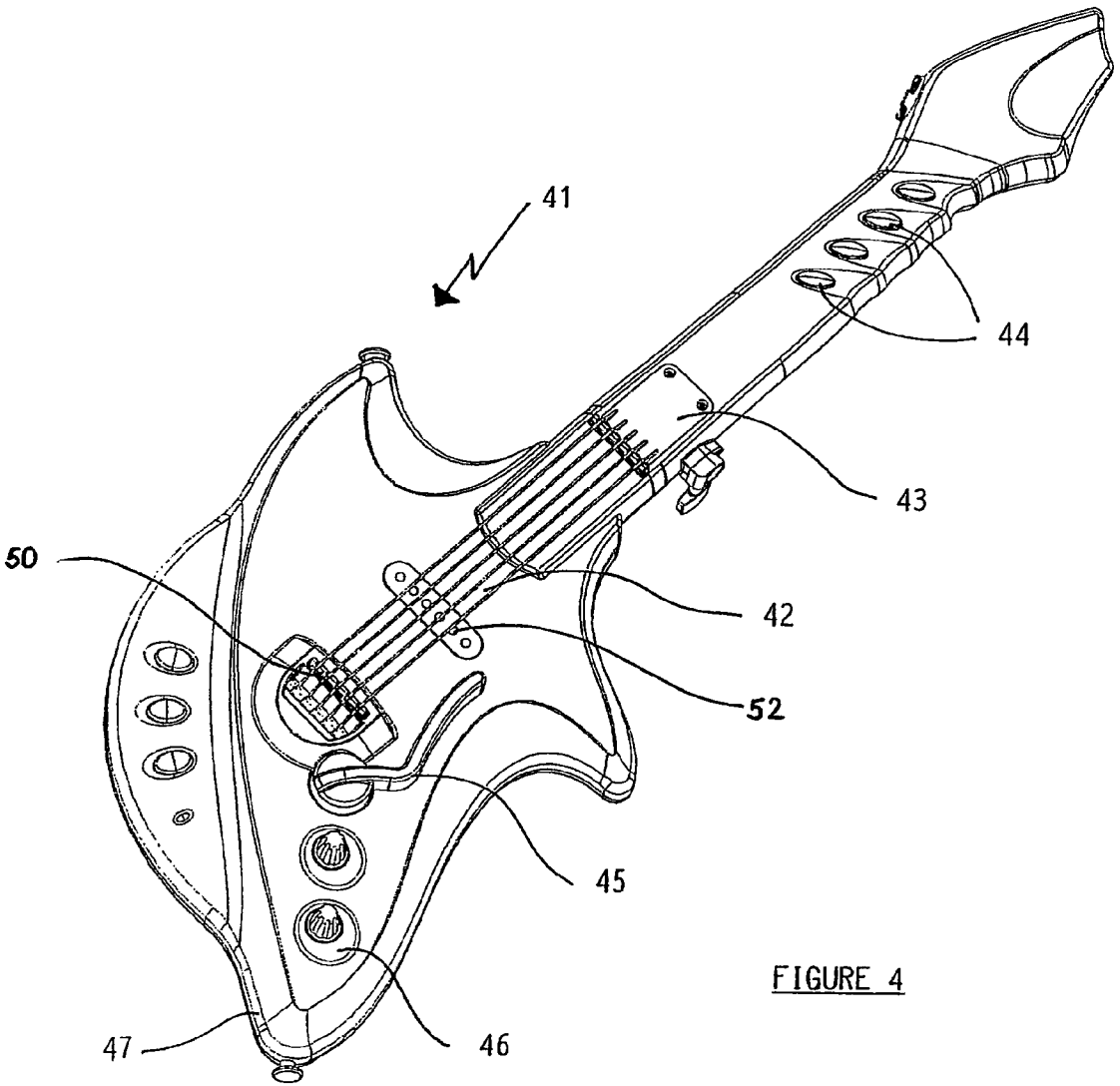
FIG. 4 is a perspective view of a digital musical instrument provided in this case by a guitar.
Figure 6:
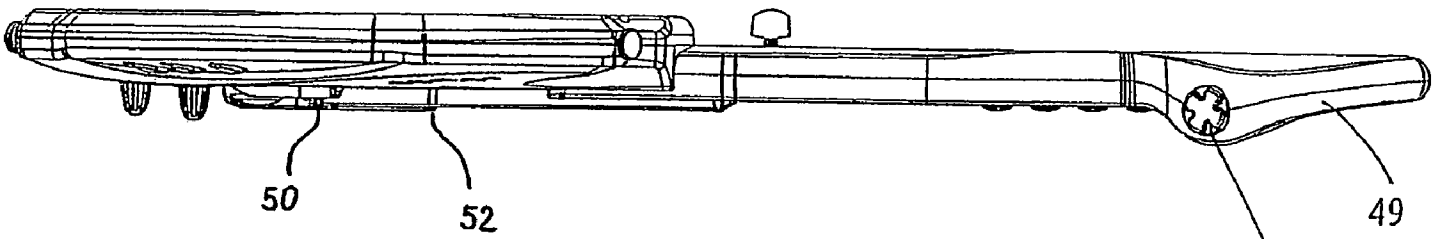
FIG. 6 is a side view of the guitar of FIGS. 4 and 5.

Referring to the drawings and now to FIG. 3 there is shown a third embodiment of an interactive multimedia apparatus indicated generally by the reference numeral 21. The apparatus 21 comprises a central control unit provided by a games console 22 having a facility to store any number of digital media in any desired file format downloaded over a modem 23. In response to electrical signals from the guitar 24, the software of the console 22 generates an audible output signal from the digital media file to the audio-visual equipment 25 in direct response to input from the user of the guitar 24.

Referring to the drawings and now to FIGS. 4 to 7, there is shown one embodiment of a digital musical instrument provided in this case by a guitar 41. The guitar 41 is provided with dynamic range state control members in the form of strings 42 and five transducers 50 and light emitting diodes (LED's) 52 disposed on the housing 43. Each transducer independently monitors a separate string 42. It will of course be appreciated that a separate transducer 50 is provided for each dynamic range state control member. A number of limited state control members 44 are provided in addition to a dynamic range state control member in the form of a tremolo arm 45 for pitch, bending and creating a tremolo effect. A further dynamic range state control member in the form of a volume control button 46 and a power indicating L.E.D. 47 are also provided on the guitar 41. Also shown in FIGS. 5 to 7, a control panel 48 is provided at the end of the arm 49 of the guitar 41 and is provided by four limited stated control members, namely switches.

In use, a user navigates through a G.U.I. of the software suite on a VDU (15, 25) using the control panel 48 and assigns specific files stored on the store to one or more control members 42, 44, 45 46. Additionally, the user may apply various effects to either or both of the limited state control members 44 and the dynamic range state control members 42, 45 46 which is more fully explained with reference to FIGS. 10 to 19 below. Once file and effect assignments are made, the user strums the guitar 41 and each string 42 vibrates up through its own transducer disposed on the housing 43. The transducers convert the mechanical vibrations to an electrical signal and forwards the electrical signal to a USB interface unit (see FIGS. 8, 9A and 9B). The USB transmits the signals to the central control unit (2, 12, 22) and in particular to the software suite stored thereon. In response to electrical signals from the guitar (3, 14, 24, 41), the software opens a file containing a variety ofsounds/images stored digitally and produces an output via connected speakers or V.D.U's.

If a user wishes to output sound from a different file, another limited state control member 44 must be pressed on the guitar 41. This in turn signals the software to open a different associated file. If a user wishes to apply a special effect they can activate any control member 42, 44, 45, 46 such as the arm 45 and volume control is achievable by twisting volume control buttons 46. When a user becomes tired of the various files that they have downloaded onto the central control unit (2, 12, 22), they may select a different collection of files using the control panel 48 in conjunction with a graphical user interface displayed on the visual display. A user can directly access the internet using the guitar 41 as a means for navigation.

Figure 8:
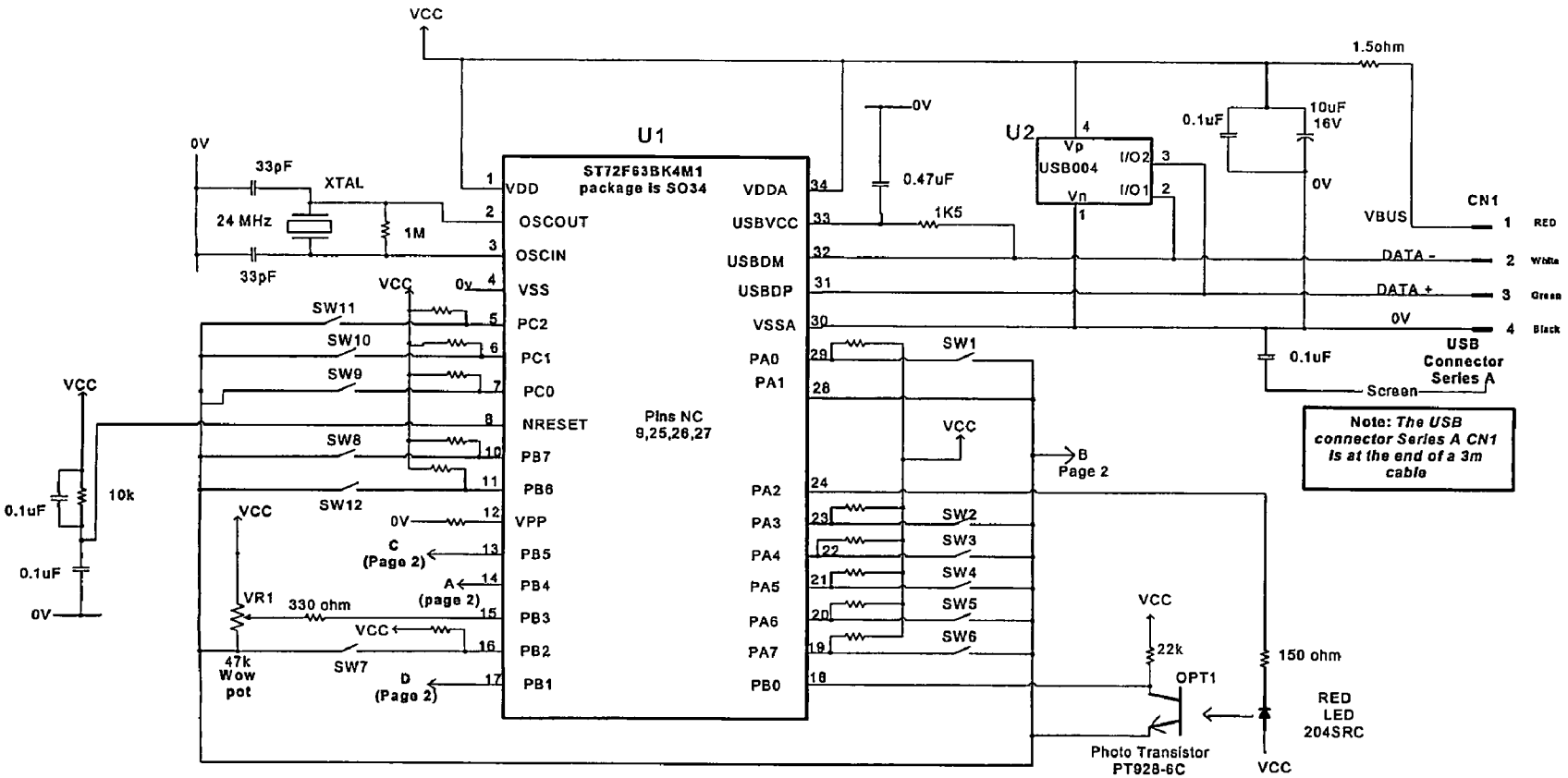
FIG. 8 is a schematic diagram of a USB (Universal Serial Bus) device.
Figure 9B:
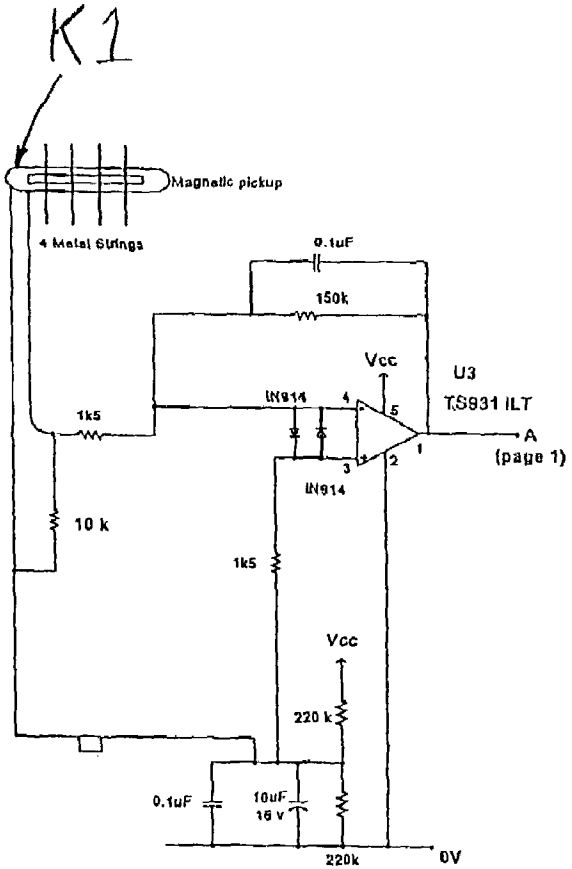
FIGURE 9B (PRIOR ART)
FIG. 9B is a schematic diagram of another section of the USB device.
Figure 9A:
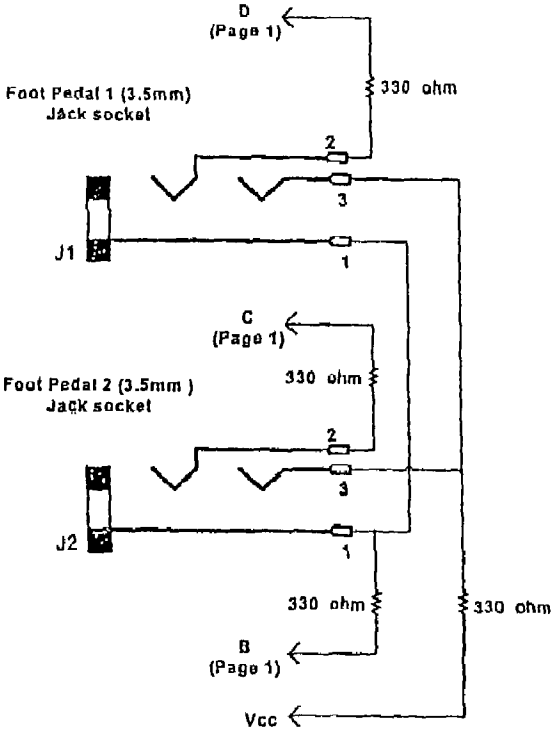
FIG. 9A is a schematic diagram of a section of the USB device.

Referring to the drawings and now to FIGS. 8, 9A and 9B, there is shown a control unit of the digital musical instrument, namely a USB (Universal Serial Bus) implementation of the interface hardware for the Interactive Multimedia apparatus (1, 11, 21), combined with a custom-designed suite of software running on a central control unit (2, 12, 22), which will provide the user with the facility to render the full range of instrumental chords by selection of pre-assigned control members (42, 44, 45, 46) and the simultaneous activation of an individual control member string (42) or a plurality of string control members (42).

This invention allows non-musical trained users to compose, accompany, solo, gig and have fin as if they were an accomplished instrument player.

Additionally the invention will assist users in developing a knowledge of chord structures, complex chord structures, scales and the location of notes on the fret of a stringed instrument (3, 14, 24, 41).

This invention allows users to not only dynamically apply global effect parameters to a selected note or chord, but will allow users to select, control and adjust any individual or group of parameters which make-up the component parameters of the selected special effect generator.

FIG. 8 and FIGS. 9A and 9B show the schematic drawings for the USB (Universal Serial Bus) Interactive Multimedia apparatus (1, 11, 21). The explanation of the circuit and its operation are as follows:

The guitar (3, 14, 24, 41) product is a USB low speed (1.5 Mhz) bus powered device. It has 12 pushbutton switches SW1 to SW12, 1 optoswitch OPT1/red LED 204SRC pair. It is connected to the PC via a 3 m 4 core screened cable.

Schematic Description

Power

The guitar (3, 14, 24, 41) product receives its +5 volts power from the PC via USB connector CN1. The maximum current drawn will be approximately 50 mA.

Hardware Reset

When power is first applied, the CPU will be reset by 2 off 0.1 uF capacitors and 10 k resistor combination. Suspend Mode. All USB devices must support suspend mode. Suspend mode enables the device to enter a low power mode if no activity is detected for more than 3 mS. Any bus activity will keep the device out of the suspend state. When the device is in suspend mode it must draw less than 500 uA. CPU Ports A and C are configured as outputs, and set to high, when entering suspend mode because as inputs each pin of ports A and C will draw 50 uA due to the internal pull-up resistors on these ports. CPU Port B does not contain any internal pull-up resistors but external pull-up resistors are implemented in hardware at the optocoupler phototransistor output. Thus all port B CPU pins should be configured as outputs and set to high applied before entering Suspend mode. Disabling the Analogue to Digital converter will save some current in suspend mode. In suspend mode the current drawn by the guitar (3, 14, 24, 41) must be less than 500 uA.

Entering Suspend Mode

1. Make PA1 output high
2. Make PA2 output high
3. Make the following port pins and outputs HIGH PA0, PA3, PA4, PA5, PA6, PA7, PB0, PB1, PB2, PB3, PB5, PB6, PB7, PC0, PC1, PC2

Note: leave PB4 as an input always

Exiting Suspend Mode

The product can be woken up from suspend mode by switching the bus state to the resume state, by normal bus activity, by signalling a reset or by an external interrupt. During suspend mode the internal CPU oscillator is turned off. In this state the CPU will not be able to detect key presses.

Leaving Suspend Mode

1. Make the following port pins Inputs
PA0, PA3, PA4, PA5, PA6, PA7, PB0, PB1, PB2, PB3, PB4, PB5, PB6, PB7, PC0, PC1, PC2 2.
Make PA2 output LOW
3. Make PA1 output LOW Guitar (3, 14, 24, 41) will only be in suspend mode:— a) When not configured in the PC b) When told to do so by the PC c) When there is no bus activity

CPU (U1)

The CPU (U1) is a ST7263 manufactured by ST Microelectronics. The CPU version is a surface mounted type called ST72T631K4M1. The CPU clock is set by a 24 MHz crystal (A)

Switches SW1 to SW12

There are a total of 12 push button switches (normally open) connected to the CPU. Each switch is monitored by 1 separate input. Each input is joined to +5 volts via a pull-up resistor. When a switch is pressed the input will drop from +5 volts to 0 volts.

Opto Switch OPT1 and LED1

OPT1 is a phototransistor which is switched on when LED1 (red LED) is on. LED1 shines light on OPT1. OPT1 is switched off by cutting the light beam with your thumb.

U2

This IC protects the CPU from any spurious signals picked up by the external wire. USB004 is a Chinese recommended part.

U3

This IC is a low power Op amp TS931 ILT. (ST Microelectronics). It is used to amplify the signal from the magnetic pickup.

J1 and J2 (3.5 mm Jack Sockets)

J1 or J2 allow for an input from a standard variable resistor foot pedal. The middle connection is the wiper of the potentiometer. A typical value for this potentiometer is approx. 22 k ohms Bill of Materials

| Qty | Description | |
|---|---|---|
| 1 | SMT resistor 1.5 ohm | 0.125 w 5% tolerance |
| 1 | SMT resistor 150 ohm | 0.25 w 5% tolerance |
| 5 | SMT resistor 330 ohm | 0.125 w 5% tolerance |
| 3 | SMT resistor 1k5 | 0.125 w 5% tolerance |
| 13 | SMT resistor 4k7 | 0.125 w 5% tolerance |
| 2 | SMT resistor 10k | 0.125 w 5% tolerance |
| 1 | SMT resistor 22k | 0.125 w 5% tolerance |
| 1 | SMT resistor 150k | 0.125 w 5% tolerance |
| 2 | SMT resistor 220k | 0.125 w 5% tolerance |
| 1 | SMT resistor 1 Mohm | 0.125 w 5% tolerance |
| 1 | 47k potentiometer (VR1) 10% tolerance | |
| 2 | SMT capacitor 33 pF ceramic 50 v 5% tolerance | |
| 5 | SMT capacitor 0.1 uF ceramic 23 v 10% tolerance | |
| 1 | SMT capacitor 0.47 uF ceramic 16 v 10% tolerance | |
| 2 | SMT capacitor 10 uF 16 v tantulum or aluminium electrolytic | |
| 1 | Red LED 204SRC/E | |
| 1 | opto transistor (OPT1)PT928-6C | |
| 1 | SMT 24 mHz crystal AEL CM309S | |

-continued

| Qty | Description |
|---|---|
| 2 | 1N914 diodes |
| 1 | CPU (U1) ST Microelectronics ST72F63BK4M1 (SMT Shrink package SO34, 300 mil width) |
| 1 | protection chip (U2) USB004 (SMT package) |

-continued

| Qty | Description |
|---|---|
| 1 | op amp (U3) TS931 ILT (ST Microelectronics) |
| 12 | SMT switches (normally open) Omron B3S-1000 |
| 5 | Tranducers (50) |
| 1 | USB screened cable 3 metres long with series 'A' Plug |

Port No.s for the Guitar

| | PORT | PIN No. (PACKAGE IS SO34) | INTERRUPT | INTERNAL PULLUP RESISTOR | TYPE OF SIGNAL | COMMENT |
|---|---|---|---|---|---|---|
| 4 Switches at bottom (Bottom is SW1, Top is SW4 | | | | | | |
| SW1 | PA0 | 29(Input) | no | pullup res. | Hi or Lo | 0 means key is pressed |
| SW2 | PA3 | 23(Input) | no | pullup res. | Hi or Lo | 0 means key is pressed |
| SW3 | PA4 | 22(Input) | Ext. Int Lo to Hi | pullup res. | Hi or Lo | 0 means key is pressed |
| SW4 | PA5 | 21(Input) | Ext. Int Lo to Hi | pullup res. | Hi or Lo | 0 means key is pressed |
| 8 Switches on neck Bottom is SW5 top is SW12 | | | | | | |
| SW5 | PA6 | 20(Input) | Ext. Int Hi to Lo | pullup res. | Hi or Lo | 0 means key is pressed |
| SW6 | PA7 | 19(Input) | Ext. Int Hi to Lo | pullup res. | Hi or Lo | 0 means key is pressed |
| SW7 | PB2 | 16(Input) | no | no | Hi or Lo | 0 means key is pressed |
| SW8 | PB7 | 10(Input) | Ext. Int Hi to Lo | no | Hi or Lo | 0 means key is pressed |
| SW9 | PC0 | 7(Input) | no | pullup res. | Hi or Lo | 0 means key is pressed |
| SW10 | PC1 | 6(Input) | no | pullup res. | Hi or Lo | 0 means key is pressed |
| SW11 | PC2 | 5(Input) | | | | 0 means key is pressed |
| SW12 | PB6 | 11(Input) | Ext. Int Hi to Lo | no | Hi or Lo | 0 means key is pressed |
| Ground pin for all 12 Switches and opto device SW1 to SW12 and opt1 | PA1 | 28(Output) (25 mA port) | no | pullup res. | Hi or Lo | Set to 0 to allow all switches SW1 to SW12 and opto1 to be detected Set to 1 in suspend mode |
| Red LED2 for OPT1 | PA2 | 24(Output) (25 mA port) | no | no | Hi or Lo | Set to 0 to light LED |
| OPT1 | PBO | 18(Input) | no | no | Hi or Lo | 1 means light is blocked |
| VR1 pot (Wow pot) | PB3 | 15(Input) | no | no | analog i/p | |
| From Amplifier U3 | PB4 | 14(Input) | Ext. Int Lo to Hi | no | analog i/p | |
| 3.5 mm Jack socket (J1) for Foot pedal 1 | PB1 | 17(Input) | no | no | analog i/p | |

-continued

Port No.s for the Guitar

| | PORT | PIN No. (PACKAGE IS SO34) | INTERRUPT | INTERNAL PULLUP RESISTOR | TYPE OF SIGNAL | COMMENT |
|---|---|---|---|---|---|---|
| 3.5 mm Jack socket (J2) for Foot pedal 2 | PB5 | 12(Input) | Ext. Int Lo to Hi | no | analog i/p | |

The above schematics and explanation are shown for example purposes only and the invention is not limited in its scope by the operation of the schematic design, the components used or the specification or capabilities of the components or the range of additional peripheral devices which could be added to the design. The design is not limited to the number of control members (switches) or magnetic pick-ups, lights etc. shown in these schematics.

Particular attention should be drawn to FIG. 9B, Label K1. The schematic shows the circuit for a standard multi-pole transducer K1 which provides a single output energy source irrespective of the fact that one or any combination of strings 42 are activated. In contrast, this invention uniquely specifies the use of a plurality of individual, uncoupled, isolated transducers that will only be energised by the activation of the individual string 42 directly associated with that string.

Each transducer output is associated with a single string and is connected to a separate pin on the CPU, in a similar fashion to that described in the schematic FIG. 8, and FIGS. 9A and 9B, which are shown as example only. The CPU would perform an analogue to digital conversion (A/D) on the sampled input. In the situation where sufficient A/D resources are not available on the CPU an external A/D converter would be required. Another alternative would be to bank switch groups of inputs, be they analogue (e.g. Transducer output) or digital (e.g. Push button). For example, assuming there is a requirement to read 16 analogue inputs, these inputs could be connected to a multiplexing device whose 8 output pins are connected to the CPU. Another pin from the CPU would control (bank switch) which bank of 8 inputs are directed to the CPU.

The two foot-pedal jack sockets J1 and J2 shown in FIG. 9A and described in the schematic workings will allow users to dynamically modify a variable control, for example volume, pan or special effect parameters controls as described later in this application. The individual transducers (magnetic pick-ups) are one method of detecting string 42 vibrations. The invention is not limited to the use of any specific tranducer type such as piezo crystal, piezo film, piezo ceramic opto-detection methods, pressure sensing, movement detection et al. could also provide acceptable solutions for sensing the vibrations, and amplitude of the vibrations. The preferred type of transducer is a piezo-electric transducer selected from a group consisting of piezo-electric crystal transducers, piezo-electric ceramic transducers and piezo-electric film transducers.

Figure 5:
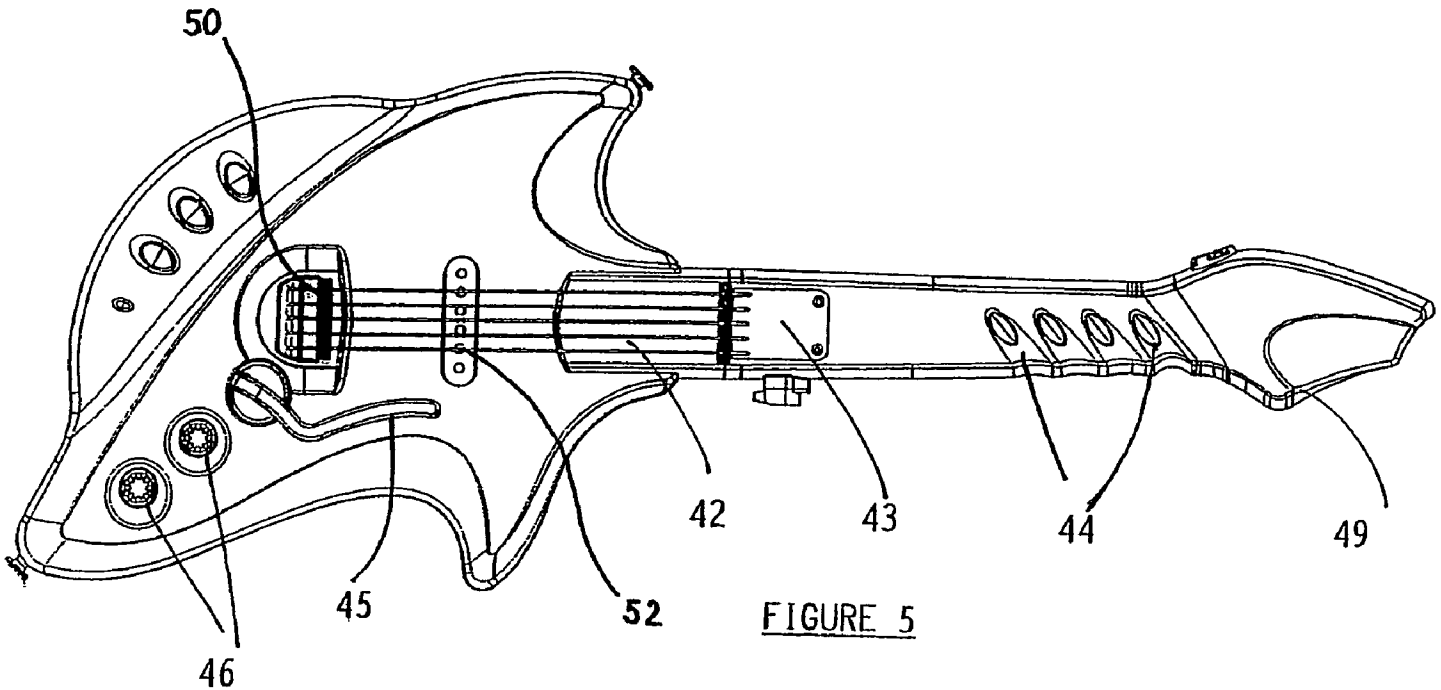
FIG. 5 is a front elevation view of the guitar of FIG. 4.
Figure 7:
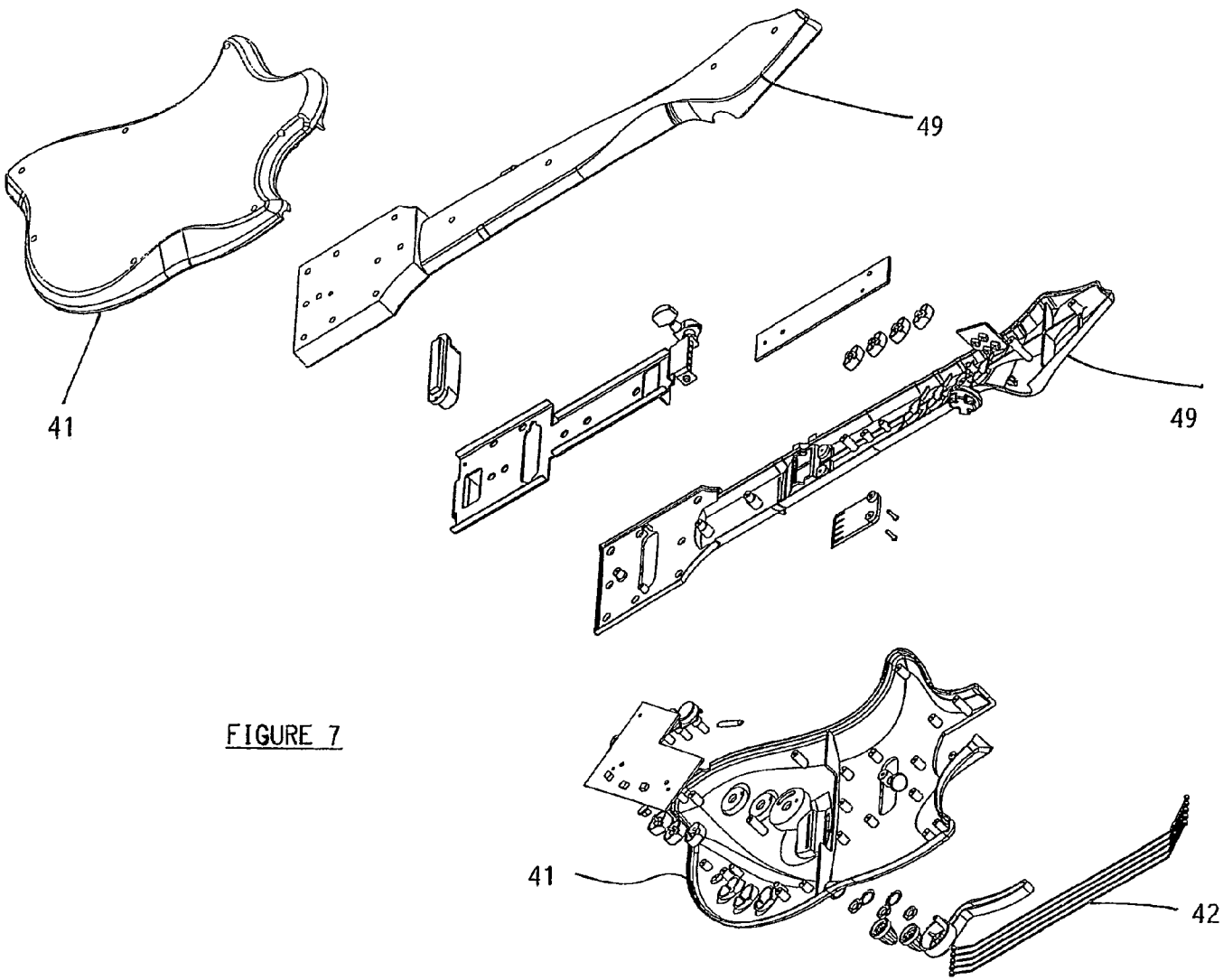
FIG. 7 is a rear exploded perspective view of the guitar of FIGS. 4, 5 and 6.

Preferably the Interactive multimedia apparatus, see FIG. 5 as an example, would include a series of coloured LED lights under each string 42, located at the neck end. The software activates the lights under the individual strings 42 which make up the selected chord, so that the user will be notified of the correct strings 42 to strum and if they so wish, they can pick the individual notes of the selected chord. This component of the application will be dealt with in more detail later in the application.

In use, the invention may be as follows;

Usually chords are played on a stringed instrument by the placement of the user's fingers on the selected strings 42 in the appropriate section of the fret on the neck piece and then the user activates the strings 42 in a manner that produces the desired sound output with the corresponding vibration amplitude and duration. The user may strum, pick, strum up, strum down, strum and pick, pick between selected strings 42 etc. to achieve their desired results. The correct fingering position on the fret for each string 42 is a critical component in the generation of each note in the overall chord structure.

Asian Pacific, European and USA music compositions use 3 note chords extensively, with the more accomplished, creative and dynamic instrumentalists using more complex chord combinations of 4, 5 and 6 notes to provide a more complete and colourful signature to their playing. 3 note chords can also have many combinations of individual notes from within its own scale, which provide the user with a rich palate of chords from which to select.

If we take as an example only, the 'C Chord' and referring to FIG. 10; The diatonic C scale is as follows:

| | | | | | | | | | | | | | |
|---|---|---|---|---|---|---|---|---|---|---|---|---|---|
| C | $C^{\#}$ | D | $D^{\#}$ | E | F | $F^{\#}$ | G | $G^{\#}$ | A | $A^{\#}$ | B | C |
| | $D^{b}$ | | $E^{b}$ | | | $G^{b}$ | | $A^{b}$ | | $B^{b}$ | | |

$D^{b}$ is the same note as $C^{\#}$ and the other b(flat) notes are equivalent of the # (sharp) notes.

$D^{b}$ is the same note as $C^{\#}$ and the other b(flat) notes are the equivalent of the # (sharp) notes.

The three note chords or triads for the C scale are C, E, G; for Cm they are C, $E^{b}$, G, for CSus4 they are C, F, G; for Cm65 they are C, $E^{b}$, $G^{b}$; for C+ they are C, E, $G^{\#}$. It is obvious that for each note there is a multiplicity of chord associations for the user to create or select from. It is nearly impossible for the non-accomplished user to create the more complex chords, particularly those using 4, 5 or 6 note combinations.

Many users with limited experience and training have been able to create simple compositions using 3 chords variations. They can use the chords of the root note of that key and the chords of the fourth and fifth notes of the scale of the root note. Limiting the creative and entertaining experience to 3 or a small number of chord combinations is most frustrating and irritating to users. To progress beyond the simple "3 chord trick" combination requires a lot of learning and practice with fret fingering etc. This invention eliminates the complexity of correct fret fingering, simple chord creation, complex chord creation, learning note combinations associated for simple and complex chords etc. Additionally this invention will quickly teach the user if they wish to learn, the correct notes associated with each chord they select and moreover the user is shown which string 42 has triggered each note of the selected chord.

This invention allows users to quickly create and render an unlimited number of combinations of simple and complex chords, where each note of the chord is rendered at its correct interval in the chord structure as it would be played by an accomplished user of a stringed instrument.

Additionally, this invention will allow the user to play complex arpeggios as the notes associated with each arpeggio are stored on file and are assigned by the software to the correct string position.

The chord generation and note rendering methodology for string-based instruments and that of keyboard-based instruments differ greatly. With keyboard-based instruments, the user usually plays a chord by simultaneously depressing the keys of the associated notes of the chord. It is not normally possible for the user of a stringed instrument to strum or to pick each note of a chord simultaneously whilst fingering the notes on the fret. This is because there is a time difference interval between the triggering of each note of the chord. This invention allows for this time difference interval, as the chord store contains the correct location of each note of the selected chord and then assigns each note to the correct string position on the interactive multimedia apparatus. Therefore, as each individual transducer's energy level is detected for each string activation, the individual notes of the chords are rendered as the corresponding string 42 is activated. In this way the user is provided with a true representation of an accomplished player's experience.

The LED visual displays under each string 42 will be energised by the application software to indicate to the user the active strings 42 for the selected notes of the chord. The provision of the LED display is to allow users to visibly see the different note assignments to each string for each chord combination. The software can apply appropriate notes to the unassigned strings 42 to simulate the sounds that these unassigned strings 42 would make if the user wishes to strike across the whole of the string area in a violent action similar to the action of their hard-rock idols. The user can chose from a set-up menu, whether they wish to configure the device for violent actions and have the software automatically trigger the correct sounds for the unassigned strings 42.

The activation of the strings 42 resulting from the user actions will be interpreted by the software to produce a sound output that truly reflects the user's striking actions.

The user experiences described above are achieved using the techniques described as follows:

In this embodiment, the Interactive Multimedia apparatus (1, 11, 21) has 12 control members, refer to FIG. 5, 44, which shows only 4 control members 44 as an example only, and any number of additional control members 44 for other assignments.

The transducer specified in this application will comprise five in number (as example only and not limited to this number) individual, uncoupled and electrically isolated transducers, which provides for five separate electrical outputs as a response to the user's activation of the individual string 42.

For example purposes only we will describe how the user will interact with the software to simulate similar results to those achieved by an accomplished instrumentalist.

Accordingly there is provided a store of recorded instrument notes from a plurality of stringed instrument types. A chord store is provided which contains the note associations for a very wide range of defined chord structures. The users, if they so wish, can additionally create their own bespoke chords or note associations, by selecting an association of notes and defining their string associations.

This chord store will provide the note associations for a very wide selection of known chord and scale definitions and structures. To simulate the playing of a stringed instrument using the Interactive multimedia apparatus (1, 11, 21) and its associated software application program, demands the faithful reproduction of the selected instrument sound in complete and total harmony and sympathy with the user's actions. It is imperative that the chord store contains the exact string assignment for each note in the chord so that the action of strumming or picking the chord will trigger the notes in the correct order that they were played by the user. In this invention, the store which has been created contains the note associations and the string assignments for each chord contained in the store. Additionally, by user selection, the chord store may assign complimentary and sympathetic notes to any or all of the unassigned strings 42. The assignment of sympathetic notes to unassigned strings 42, will provide a more colourful and verbose chord rendering.

Figure 11:
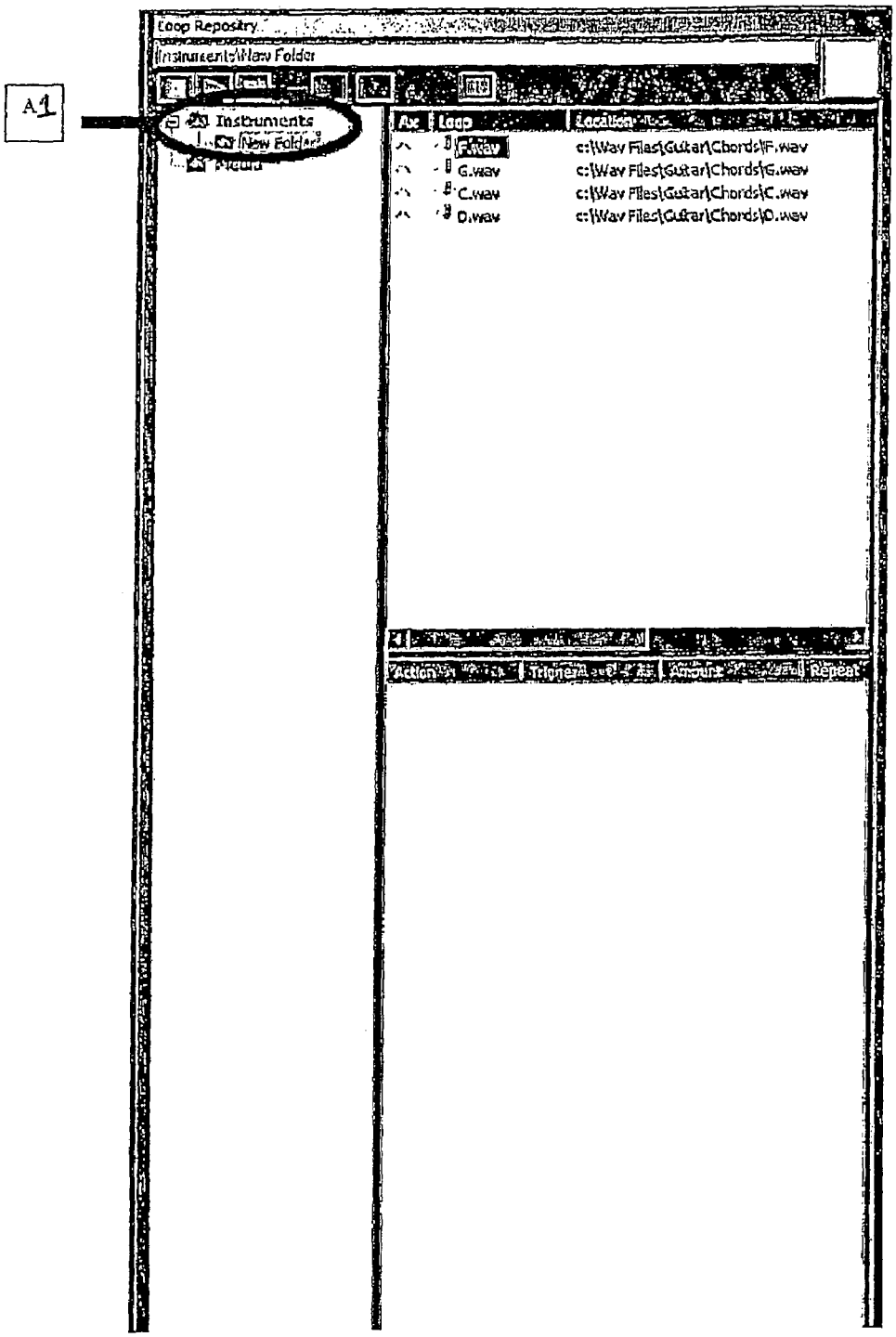
FIG. 11 is a screen shot showing the instrument selection folder.

Accordingly, if the user wishes to render a chord, for example the chord 'C', the user would firstly select the instrument file as shown in FIG. 11 Label A1 and then select the chord 'C' from the chord store for the selected instrument type, see FIG. 10 Label A. The user would then be presented with a drop down menu of all the C chord variations held in the store, for example purposes only see FIG. 10 Label A. The user may wish to select the major chord, FIG. 10 Label B, which contains the notes C, E, G. The chosen chord must then be assigned to a control member, see FIG. 5, reference numeral 44, which will select that chord when the user activates that control member 44. The chord assigned to that control member 44 will be rendered by the software when the user activates the strings 42 of the Interactive Multimedia apparatus (1, 1, 21). The software will have automatically assigned the notes of the selected chord to the appropriate strings 42 of the interactive multimedia apparatus (1, 11, 21) so that the individual transducer associated with each string 42 will detect the user's actions in striking the string 42 and provide an audio output for the associated assigned note that will faithfully represent the response to the user's actions.

String assignments for the Simple D major chord would be String 1, Note $F^{\#}$; String 2, Note D and String 3, Note A. If the user has pre-selected the option to apply an additional note, then the software will add a further note 'D' to the $4^{th}$ String.

Figure 12:
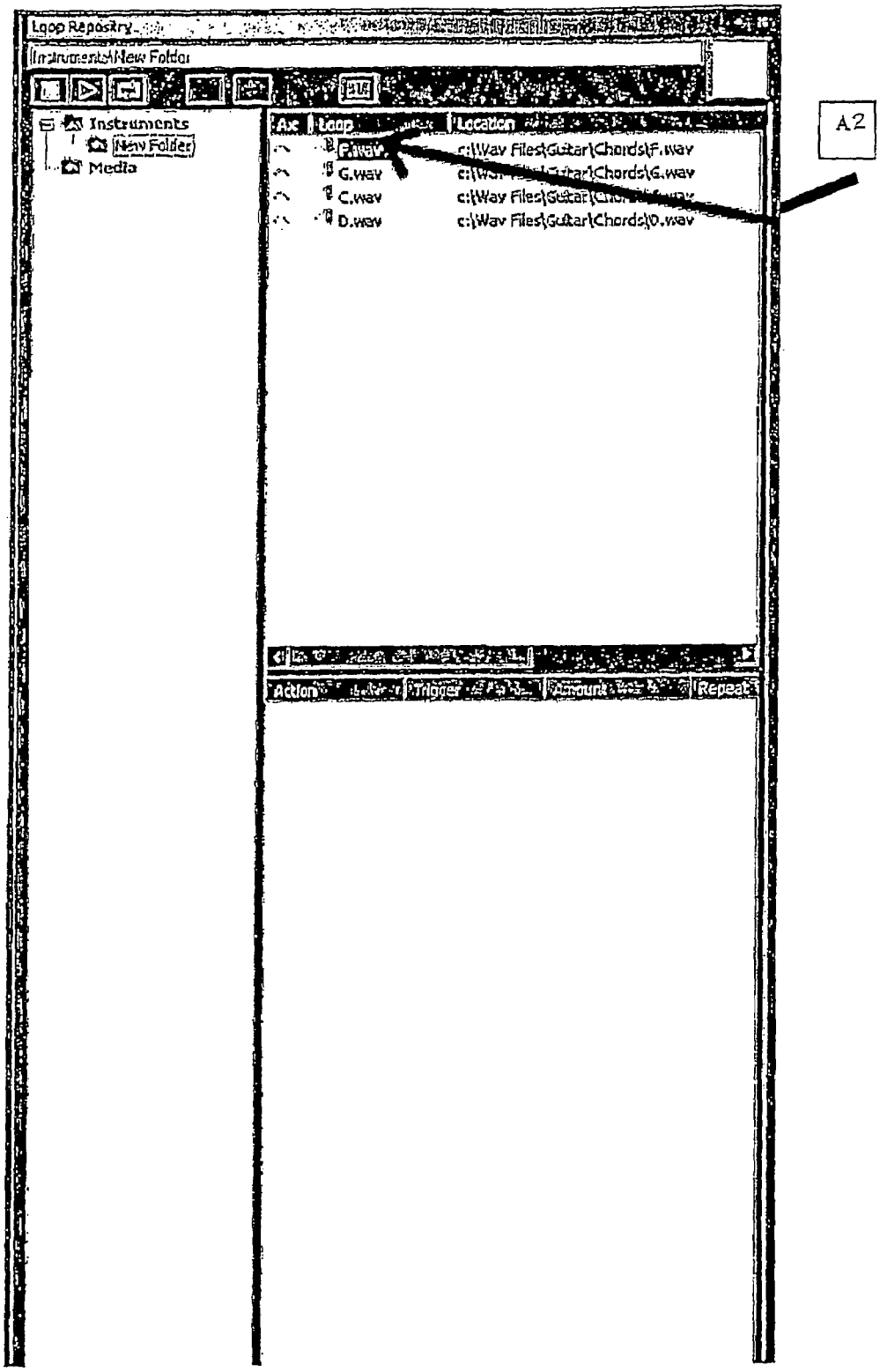
FIG. 12 is also a screen shot showing the instrument selection folder.
Figure 13:
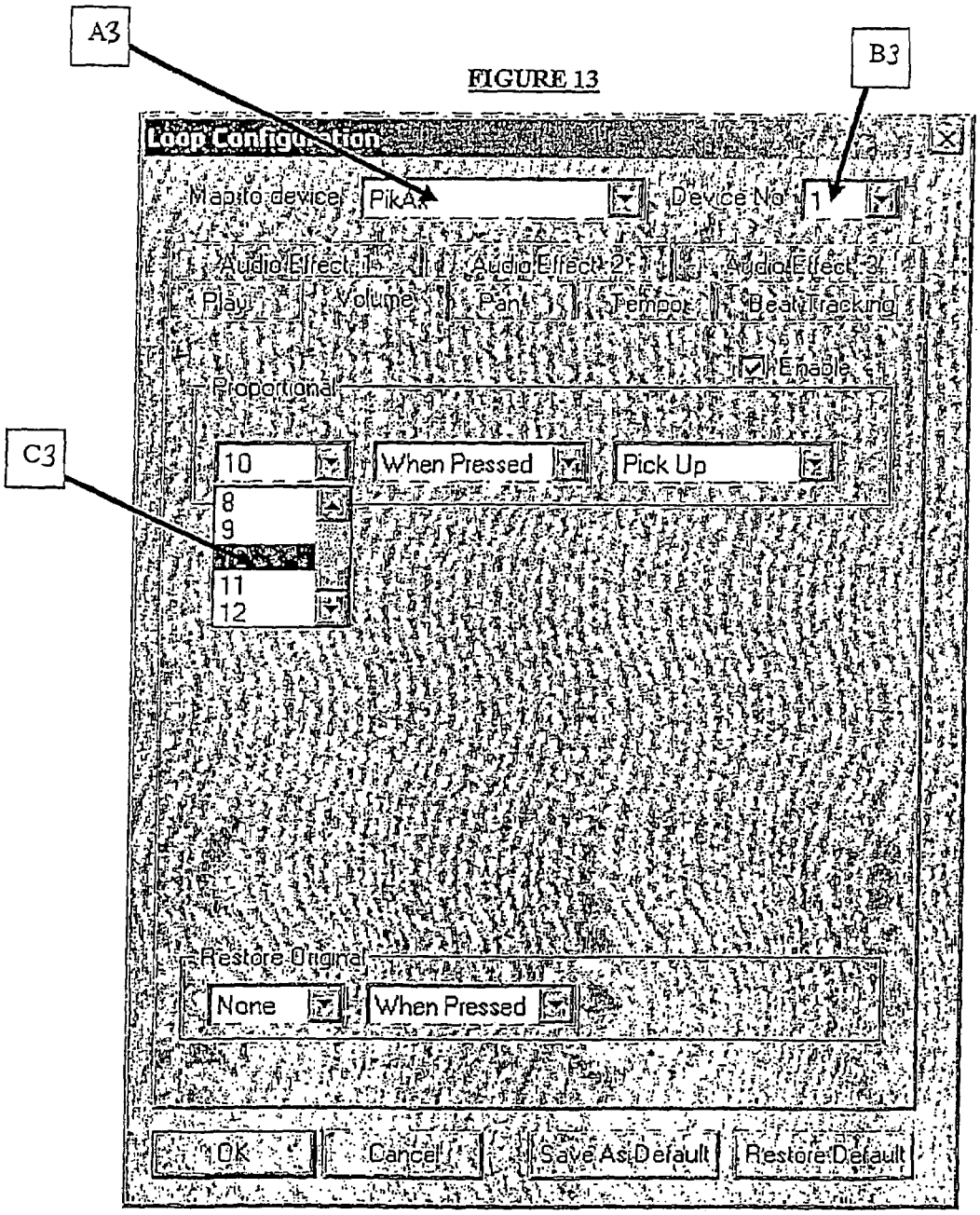
FIG. 13 is a screen shot showing a control member functionality assignment screen.

The user can assign chords and special effects to the control members 44, which for example purposes only will be illustrated as follows; the user will select from a window, see FIG. 12 Label A2, the particular chord they wish to assign to a control member 44. The user is then presented with a menu as shown in FIG. 13. The user must select the device type from a plurality of devices, as shown in FIG. 13 Label A3. For example purposes only we show a guitar-type device called the 'PikAx' in FIG. 13 Label A3. The user must then select the device number they wish to be configured, see FIG. 13 Label B3. This application allows for a plurality of devices in each class of device and for a plurality of different device classes. The user will then select from a drop-down menu, see FIG. 13 label C3, containing various control member identifier options. The user specifies which control member they wish to assign the selected chord to. For example purposes only, we show in FIG. 13 Label C3, the control member being identified as Switch 10, See FIG. 5, reference numeral 44. The user will then select the electrical state the control member 44 must reach to be in the state of assertion for the selection of the assigned chord, as shown for example purposes only in FIG. 14 Label A4. The drop-down menu as show in FIG. 14 Label A4 illustrates for example purposes only, four conditions of assertion—'when pressed', 'when released', 'while pressed' and 'while released'. The user will then select the triggering method for the control member, see FIG. 14 Label B4, which when asserted will provide the stimulus to the software to render the notes of the chord in direct response to the software's interpretation of the control members vibrations or activations. In some device class types, the activation source may not be a vibrating mechanism, but some other pressure sensing device, an opto-coupled device or any other transducer, which provides an electrical output in response to a user's actions.

Figure 14:
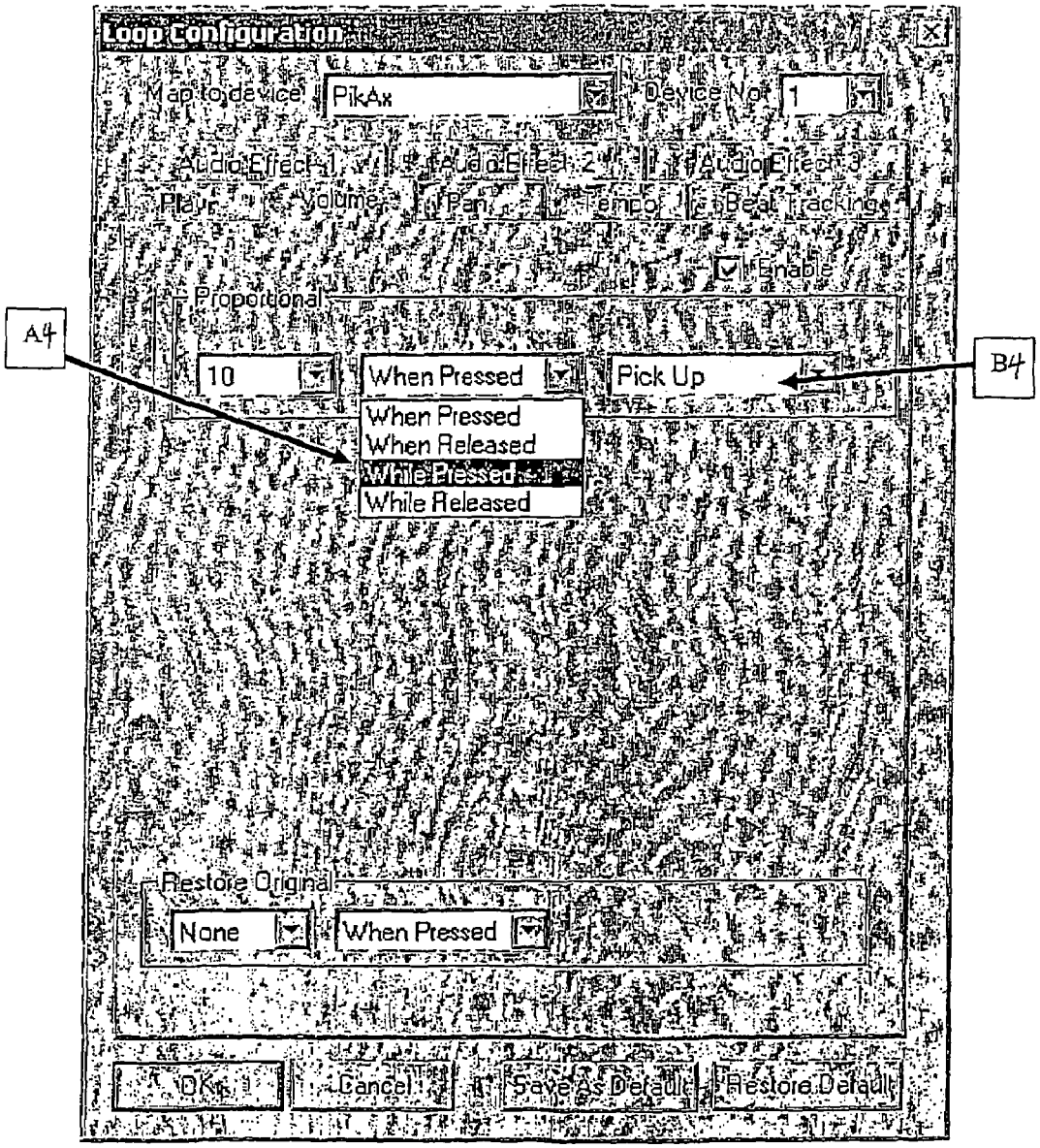
FIG. 14 is also a screen shot showing the control member functionality assignment screen.
Figure 15:
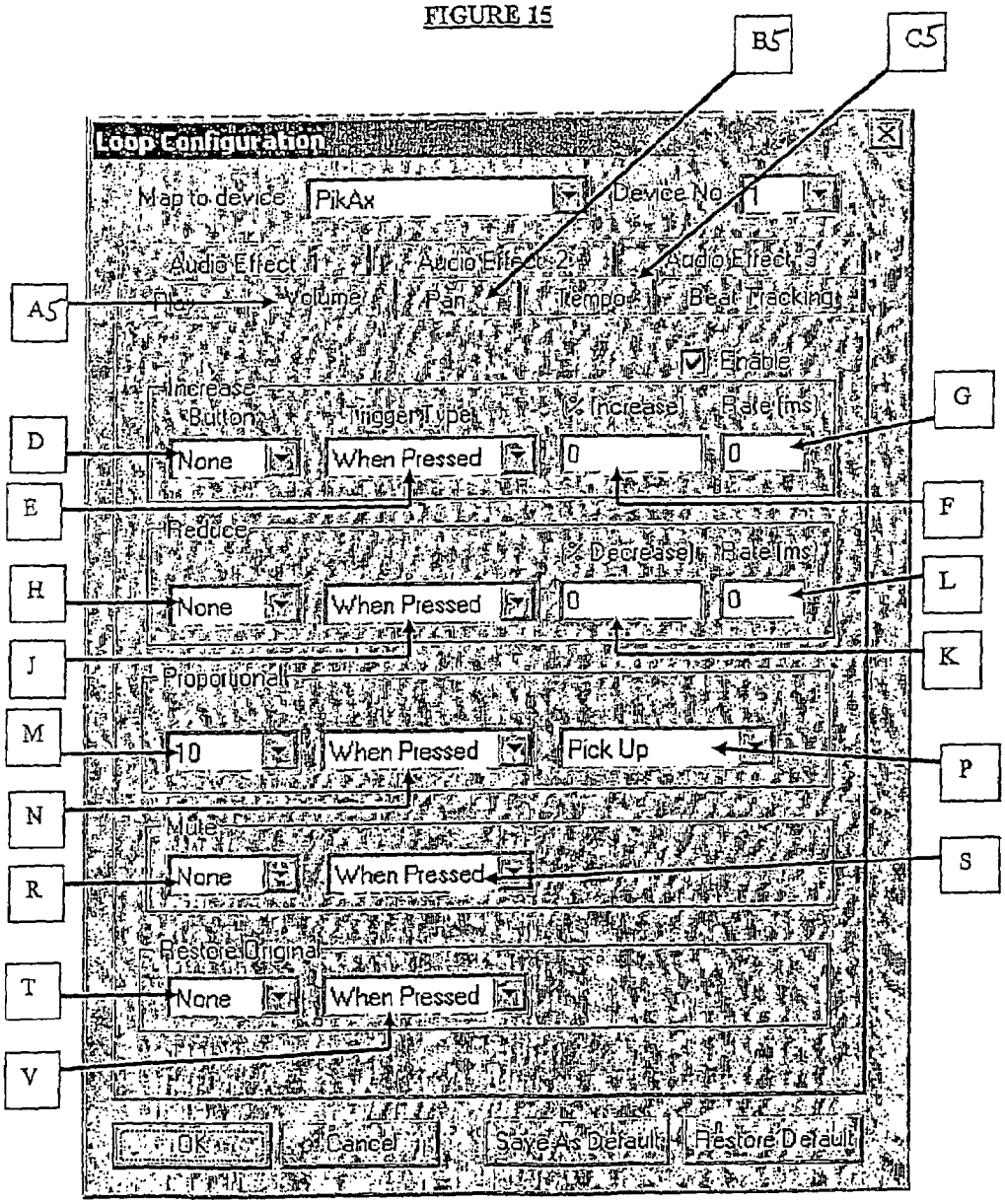
FIG. 15 is also a screen shot showing a further control member functionality assignment screen.
Figure 16:
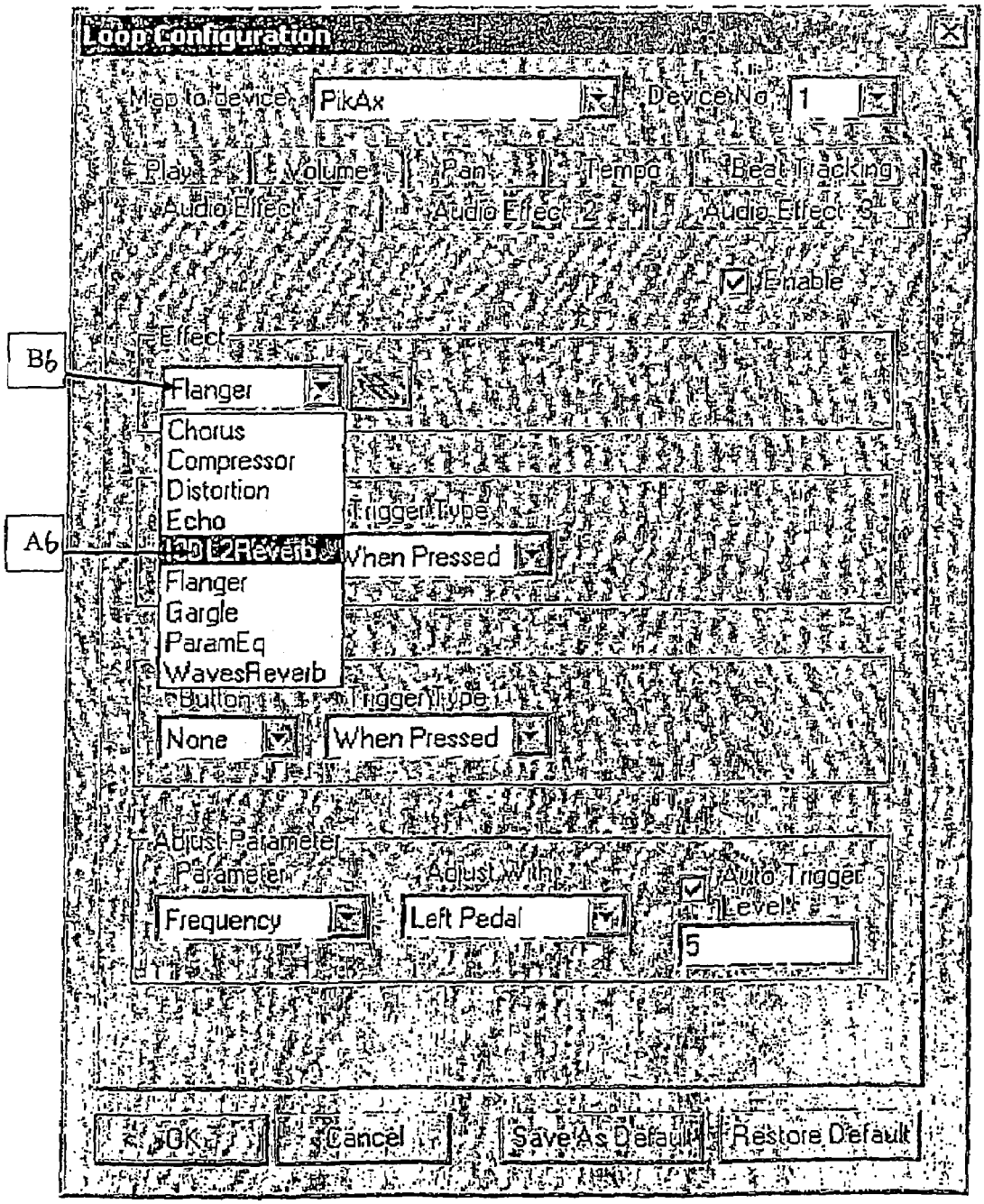
FIG. 16 is a screen shot showing a special effects assignment screen.

In this example we show in FIG. 14 Label B4 that a vibration sensitive transducer is the selected activation device for triggering the notes of the assigned chord. The user may wish to adjust various effects, controls, characteristics or parameters of the sound output by using either a fixed or adjustable control member (42, 44, 45, 46). In FIG. 15, we show for example purposes only, a range of controls that the user may wish to adjust dynamically by using one of the dynamic range state control members (42, 45, 46) shown in FIG. 19 Label A8 or by using any of the limited state control members 44 shown in FIG. 13 Label C3. The user may wish to increase the output volume, see FIG. 15 Label A5; the pan control, see FIG. 15 Label B5; the tempo, see FIG. 15 Label C5 or any other control or parameter they may consider is desirable to adjust dynamically. In this example, for a limited state control member 44, the user will assign the selected control member 44 for the control adjustment by selecting from the drop-down menu, FIG. 15 Label D and then selecting the assertion state for that control member FIG. 15, Label E and then selecting the percentage adjustment they wish to apply, FIG. 15 Label F and also the rate of change in milliseconds at which they wish to apply the change, FIG. 15 Label G. Similarly to reduce the volume, pan, and tempo the user selects and assigns the controls as shown in FIG. 15 Label H, J, K, L.

Figure 17:
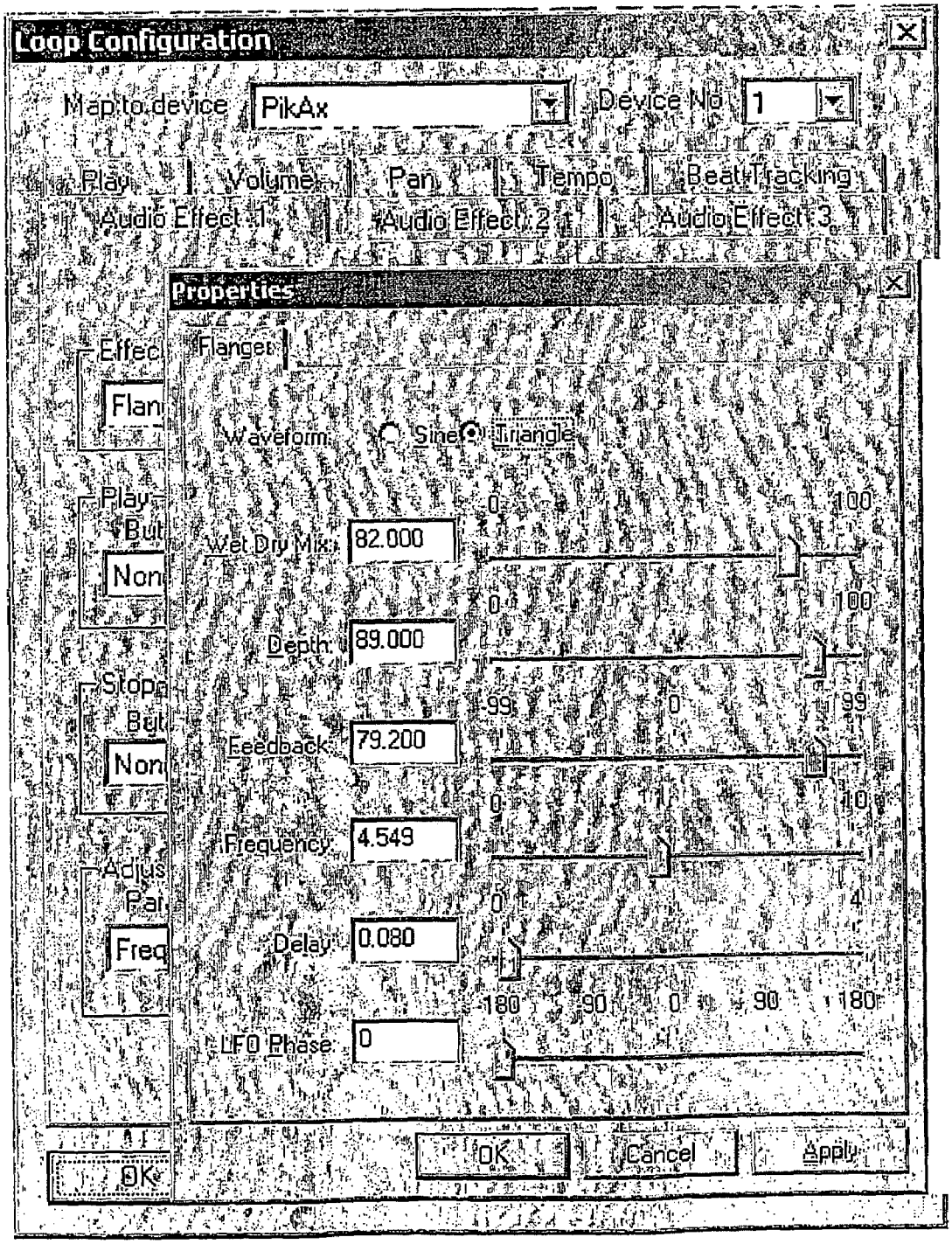
FIG. 17 is a screen shot showing a further special effects assignment screen.
Figure 18:
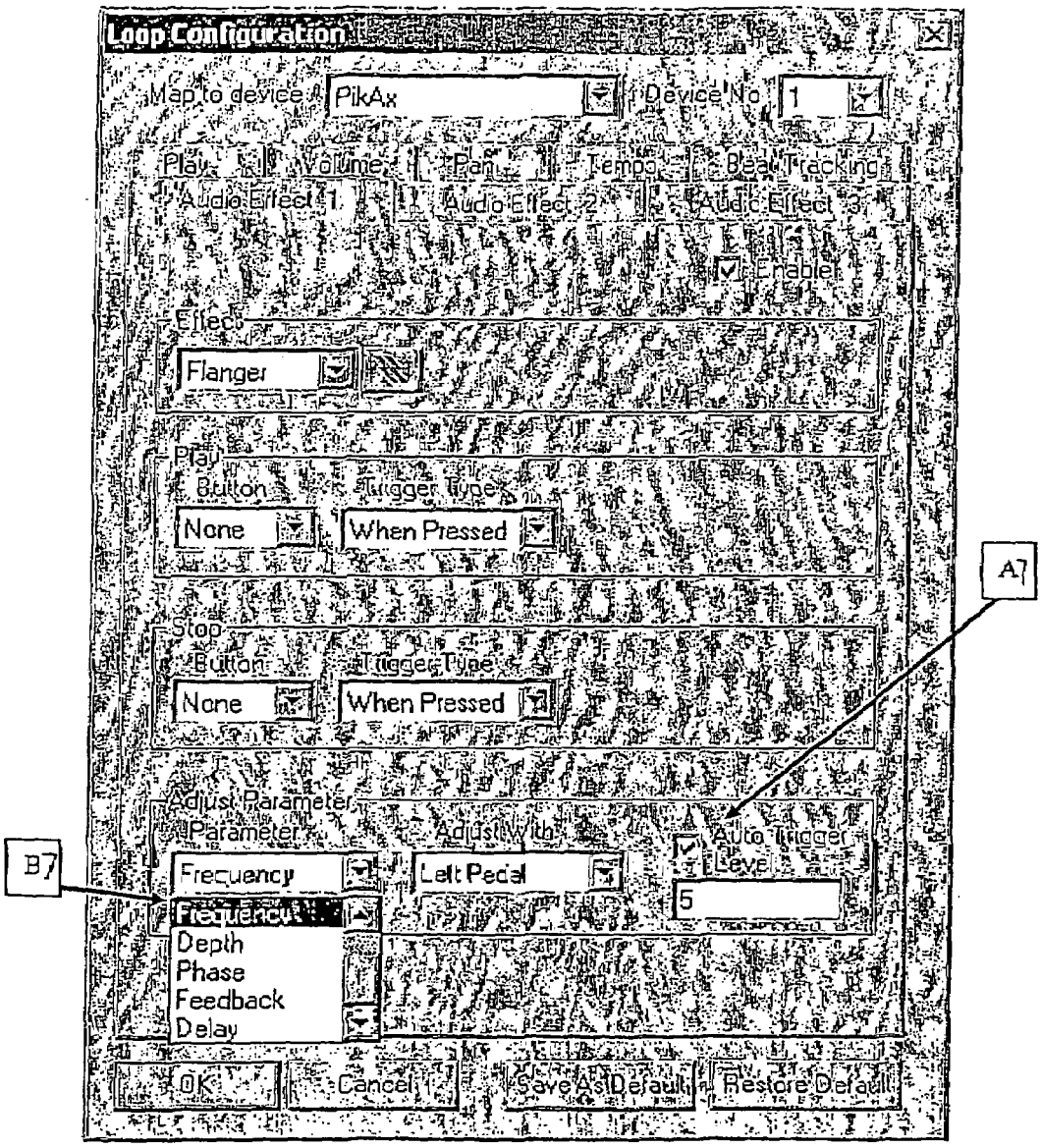
FIG. 18 is a screen shot showing further options on the special effects assignment screen.
Figure 19:
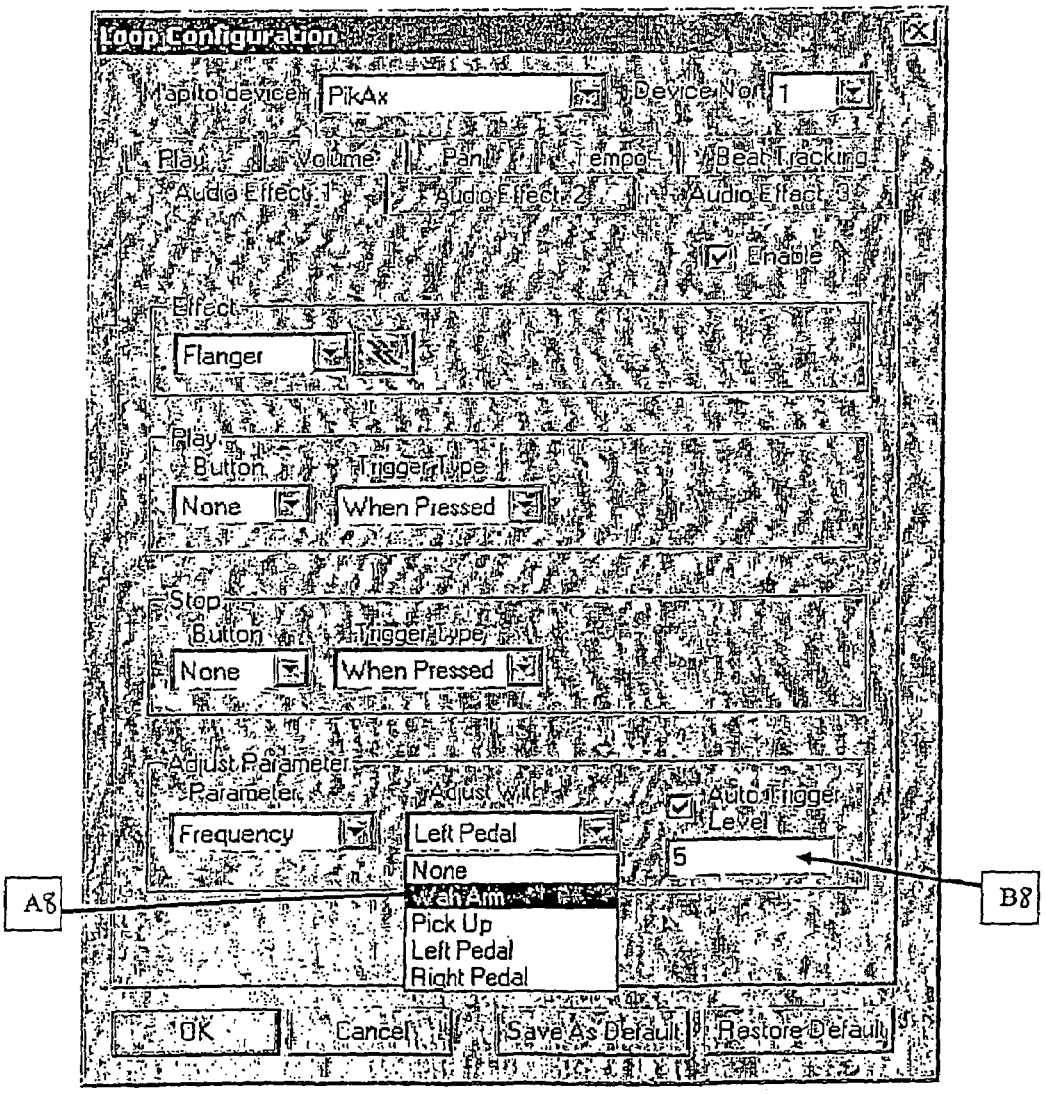
FIG. 19 is a further screen shot showing a special effects assignment screen assigning special effects to specific control member.

When using an adjustable control member (42, 45, 46), the user will select and assign the appropriate control members, FIG. 15, Label M, N, P. The user may wish to mute the output by selecting and assigning the control member and their assertion states, see FIG. 15 Label R and S. The user may wish to restore the original settings by selecting and assigning a control member, see FIG. 15 Label T and V. Another significant and unique component of this application is the ability of the software to dynamically and in real time, adjusts the individual parameters of a special effect, which is being applied to an individual note or notes of the selected chord, while it is being rendered by the central control unit. In this application and for example purposes only, we show in FIG. 16 Label A6, a range of special effect choices from which the user may select and which they may apply dynamically to a chord or note or a combination of notes. In this example, we show that the user has selected 'flanger', see FIG. 16 Label B6. FIG. 17 shows, as example only, some of the key parameter adjustments that affect the generation of the 'flanger' special effect. The user may adjust any or all of these parameters to provide a composite sound effect of their choice. Additionally the user may wish to dynamically adjust in real-time during their playing activity any or all of the individual parameters to create contrasting sound effects. The user sets the individual slider controls for each parameter as in FIG. 17 to provide the composite sound effect results they desire. The user will then assign the parameters they wish to adjust dynamically and in real-time as follows; the user wishes to adjust a parameter of the 'flanger' special effect and to have the selected parameter immediately activated in response to their operation of an adjustable control member. (42, 45, 46) FIG. 18 Label A7 shows a selection box, which when selected will tell the software to automatically apply the adjustments when the selected control member is activated. FIG. 18 Label B7 shows a drop-down menu containing the individual parameters of the special effect being applied as in FIG. 17. The user selects the individual parameter they wish to dynamically adjust and in this example it is the frequency. The user will then assign the adjustable control member they desire as the trigger mechanism, see FIG. 19 Label A8. In this example, it is a foot-pedal. Additionally there is allowance, as in FIG. 19 Label B8, for the user to select a minimum threshold level before the adjustable control member (42, 45, 46) kicks in. Setting this minimum threshold level in the activation of the parameter adjustment allows for differing tolerances in the electrical properties of proportional potentiometers and other proportional measurement devices.

When the user activates the selected control member (42, 44, 45, 46), which in this example is a foot-pedal, beyond the minimum threshold level of 5%, then the software will adjust the frequency parameter of the effect in sympathy with the movement of the dynamic range state control member (42, 45, 46).

Additionally there is provided further embodiments of this invention, which provides an entertaining, but less challenging and less educational experience for the user. In this further embodiment, the chords would be rendered by the software in response to the user striking any of the strings 42 of the interactive multimedia apparatus (1, 11, 21), in any sequence of strumming, picking etc. In this further embodiment, the notes of the chords are not rendered as a response to the individual string 42 activation as described in the earlier embodiment. This embodiment may be a starting position of choice for beginners, who would quickly progress to the more advanced embodiment as described earlier in this application. In this embodiment, the user must select the preferred tempo they wish to use. The software will trigger the rendering of the notes of the selected chord at time intervals appropriate to the selected tempo.

Additionally, the chord store is not restricted to the notes of a variety of string instrument types. The chord store could include notes, chords or sounds from any instrument type or from any percussion type instrument or from any wind-based instrument or from any reed-based instrument or from any instrument that is activated by a bow movement or from any device that comes within the classification of a musical instrument, which would be rendered as either individual notes, chords or sounds or combination of sounds by user selection. This invention is not limited in any way by the examples provided in this application or to the instrument types or to the method of application or stimulation.

It is to be understood that the invention is not limited to the specific details described above which are given by way of example only and that various modifications and alterations are possible without departing from the invention as defined in the appended claims.

The invention claimed is:

1. An interactive multimedia apparatus comprising:

a digital musical instrument having a plurality of control members including at least one limited state (ON/OFF) control member and at least one dynamic range state control member including at least one user-activated source of a musical note, wherein a state of each of the plurality of control members is selectable by a user;

a central control unit having a store of digital media including digital audio files stored thereon and a suite of software for assigning one of the digital audio files to the at least one limited state control member, for interpreting the user-selected state of the plurality of control members in order to select, open and render the assigned digital audio files from the store of digital media, and for assigning a musical note to the at least one user-activated source in accordance with a user-selected digital audio file, the assigned digital audio file being selectable by a user by activating the ON state of the corresponding at least one limited state control member;

a control unit associated with the digital musical instrument and adapted to communicate with the central control unit, the control unit having:

a CPU for identifying and monitoring the user-selected state of the plurality of control members, the control unit being adapted to communicate each user-selected state of the plurality of control members to the central control unit; and a plurality of independent, uncoupled transducers, wherein each transducer is associated with and configured to monitor one of the at least one user-activated source of a musical note and to convert activation of the one of the at least one user-activated source into electrical signals associated with the corresponding assigned musical note and with the user-selected state of the plurality of control members.

2. An interactive multimedia apparatus as claimed in claim 1, wherein the independent, uncoupled transducers are selected from a group of electrical, optical, pressure, movement, magnetic and piezo-electric transducers.

3. An interactive multimedia apparatus as claimed in claim 2, wherein the independent, uncoupled transducers are piezo-electric transducers selected from a group consisting of piezo-electric crystal transducers, piezo-electric ceramic transducers and piezo-electric film transducers.

4. An interactive multimedia apparatus as claimed in claim 1, wherein the digital musical instrument is a guitar/guitar type device.

5. An interactive multimedia apparatus as claimed in claim 1, wherein the at least one user-activated source of a musical note is a string of a stringed instrument, each string of the stringed instrument being associated with one of the plurality of independent, uncoupled transducers.

6. An interactive multimedia apparatus as claimed in claim 5, wherein the store further comprises a chord and scale store of digital media containing the note associations for a wide range of defined chord and scale sequences, the store also defining the correct note associated with each string position for the selected chord or limited scale sequence so that the notes are played in the correct sequence when the strings are strummed up or down.

7. An interactive multimedia apparatus as claimed in claim 1, wherein the at least one dynamic range state control member includes a foot pedal.

8. An interactive multimedia apparatus as claimed in claim 7, wherein the foot pedal is monitored by a potentiometer.

9. An interactive multimedia apparatus as claimed in claim 7, wherein activation of the foot pedal dynamically modifies a variable control.

10. An interactive multimedia apparatus as claimed in claim 9, wherein the variable control is one of a volume, pan or special effect parameter control.

11. An interactive multimedia apparatus as claimed in claim 1, wherein the central control unit has a visual display unit (V.D.U.) and the suite of software has a graphical user interface (G.U.I) displayable on the V.D.U.

12. An interactive multimedia apparatus as claimed in claim 11, wherein the control unit of the digital musical instrument has a control panel comprising a plurality of limited state control members, namely switches for navigating through the G.U.I. of the software suite.

13. An interactive multimedia apparatus as claimed in claim 12, wherein the central control unit has memory for storing user assignments of digital media against specific control members, the memory being accessible by a software module of the software suite in response to activation of a control member or by activation of a combination of one or more limited state or dynamic range state control members to open, render, modify, adjust, add effects, change parameters and change controls of the rendered digital media.

14. An interactive multimedia apparatus as claimed in claim 1, wherein indicators are provided on the digital musical instrument and are controllable by software on the central control unit in response to an assignment of digital media against specific control members by a user, the indicators being provided to show the user which of the dynamic range state control members have been assigned to produce an audio/visual output if activated.

15. An interactive multimedia apparatus as claimed in claim 1, further comprising a plurality of light emitting diodes (LED), each LED being proximate to one of the at least one user-activated source of a musical note, wherein each LED proximate to the one of the at least one user-activated source associated with the assigned digital audio file is energized in response to a user selecting the assigned digital audio file.

16. An interactive multimedia apparatus as claimed in claim 1, wherein between one and sixteen limited state (on/off) control members and between one and twelve dynamic range state control members are provided.

17. An interactive multimedia apparatus as claimed in claim 1, wherein each control member is associatable with any file stored in the store of the central control unit.

18. An interactive multimedia apparatus as claimed in claim 1, wherein at least some of the digital audio files are recorded instrument notes of a plurality of stringed instrument types.

* * * * *